US012687104B2

(12) United States Patent
Steele

(10) Patent No.: US 12,687,104 B2
(45) Date of Patent: Jul. 21, 2026

(54) PERFORMING DOWNHOLE TEST OF A WELL DEVICE FUNCTION IN A WELL SYSTEM AND COMMUNICATING THE TEST RESULTS

(71) Applicant: Halliburton Energy Services, Inc., Houston, TX (US)

(72) Inventor: David J. Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/361,110

(22) Filed: Jul. 28, 2023

(65) Prior Publication Data

US 2025/0034992 A1 Jan. 30, 2025

(51) Int. Cl.
*E21B 47/12* (2012.01)
*E21B 47/10* (2012.01)

(52) U.S. Cl.
CPC ..... *E21B 47/12* (2013.01); *E21B 47/10* (2013.01)

(58) Field of Classification Search
CPC ..... E21B 47/12; E21B 47/10
See application file for complete search history.

(56) References Cited

U.S. PATENT DOCUMENTS 9,416,638 B2 8/2016 Zhou
9,963,962 B2 5/2018 Fehr et al.
2013/0319683 A1 12/2013 Aldridge
2016/0010421 A1* 1/2016 Henderson ..... E21B 33/129 166/147
2018/0252100 A1* 9/2018 Ranjan ..... E21B 47/017
2018/0274316 A1 9/2018 Dancer
2021/0062622 A1 3/2021 Pace
2022/0205331 A1 6/2022 Xu

FOREIGN PATENT DOCUMENTS

CN 109186866 1/2019

OTHER PUBLICATIONS

"PCT Application No. PCT/US2023/071342, International Search Report and Written Opinion", Apr. 17, 2024, 11 pages.

(Continued)

*Primary Examiner* — Crystal J Lee
(74) *Attorney, Agent, or Firm* — DeLizio, Peacock, Lewin & Guerra LLP

(57) ABSTRACT

Systems, methods, and apparatus for performing a downhole test of completion of a function performed by a downhole well device in a well system and communicating the test results to the surface. A downhole well device may perform a downhole function in the well system. For example, the downhole function may be a setting function, an actuating function, or an anchoring function. A downhole test apparatus may perform a downhole test to determine whether the downhole function was completed successfully. For example, the downhole test may be a downhole seal test or a downhole anchor test. Based on the result of the downhole test, the downhole test apparatus may provide an indication from downhole to surface equipment of the well system that indicates whether the downhole function was completed successfully.

20 Claims, 12 Drawing Sheets

(56) References Cited

OTHER PUBLICATIONS

"Openhole Whipstock Systems", Baker Hughes: https://www.bakerhughes.com/fishing-services/casing-exit-whipstock-systems/openhole-whipstock-systems, 2023, 3 pages.
"PathBreaker: Whipstock with Hydraulic Anchor System", Stockholm Precision Tools, sptab.com, 2023, 2 pages.
"Remotely Operated Technology Achieves Global Milestone with 1,000 eRED® Valve Installations", Halliburton Completion Tools, https://www.halliburton.com/en/resources/ered-valve-1000-installations-cs, 2023, 2 pages.
"X-it Reliable Sidetracks", archerwell.com, 2019, 2 pages.
Childers, et al., "Milling the Window and Drilling the Lateral in One Trip: Case Histories and Developments", AADE National Drilling Technical Conference, 2001, 9 pages.
Foster, et al., "Improving Multilateral Drilling and Completion Efficiency with a Hollow Whipstock", 1998 IADC/SPE Drilling Conference, Mar. 1998, 12 pages.
Heaney, et al., "Digital Slickline: Case Studies Using an Electro-Mechanical Setting Tool and Downhole Anchor Tool", SPE Annual Technical Conference & Exhibition originally scheduled to be held in Denver, Colorado, USA, Oct. 5-7, 2020., Oct. 2020, 16 pages.

* cited by examiner

PERFORMING DOWNHOLE TEST OF A WELL DEVICE FUNCTION IN A WELL SYSTEM AND COMMUNICATING THE TEST RESULTS

TECHNICAL FIELD

The present invention relates generally to oil and gas systems and services, and more specifically to performing a downhole test of a well device function in a well system and communicating the test results.

BACKGROUND

The oil and gas services industry uses several types of well systems for oil and gas exploration and production (E&P) operations, such as drilling, production, workover, and completion well systems. The oil and gas services industry uses various types of surface equipment in well systems, and the well systems utilize a variety of downhole well tools and devices. The downhole well tools and devices perform various functions for the well system. However, the well systems typically do not have any downhole mechanisms to perform downhole tests that determine or verify whether the functions were performed successfully by the downhole well tools and devices. Also, the well systems typically do not have any downhole mechanisms to communicate or report the downhole tests results to the surface.

DESCRIPTION

Figure 1:
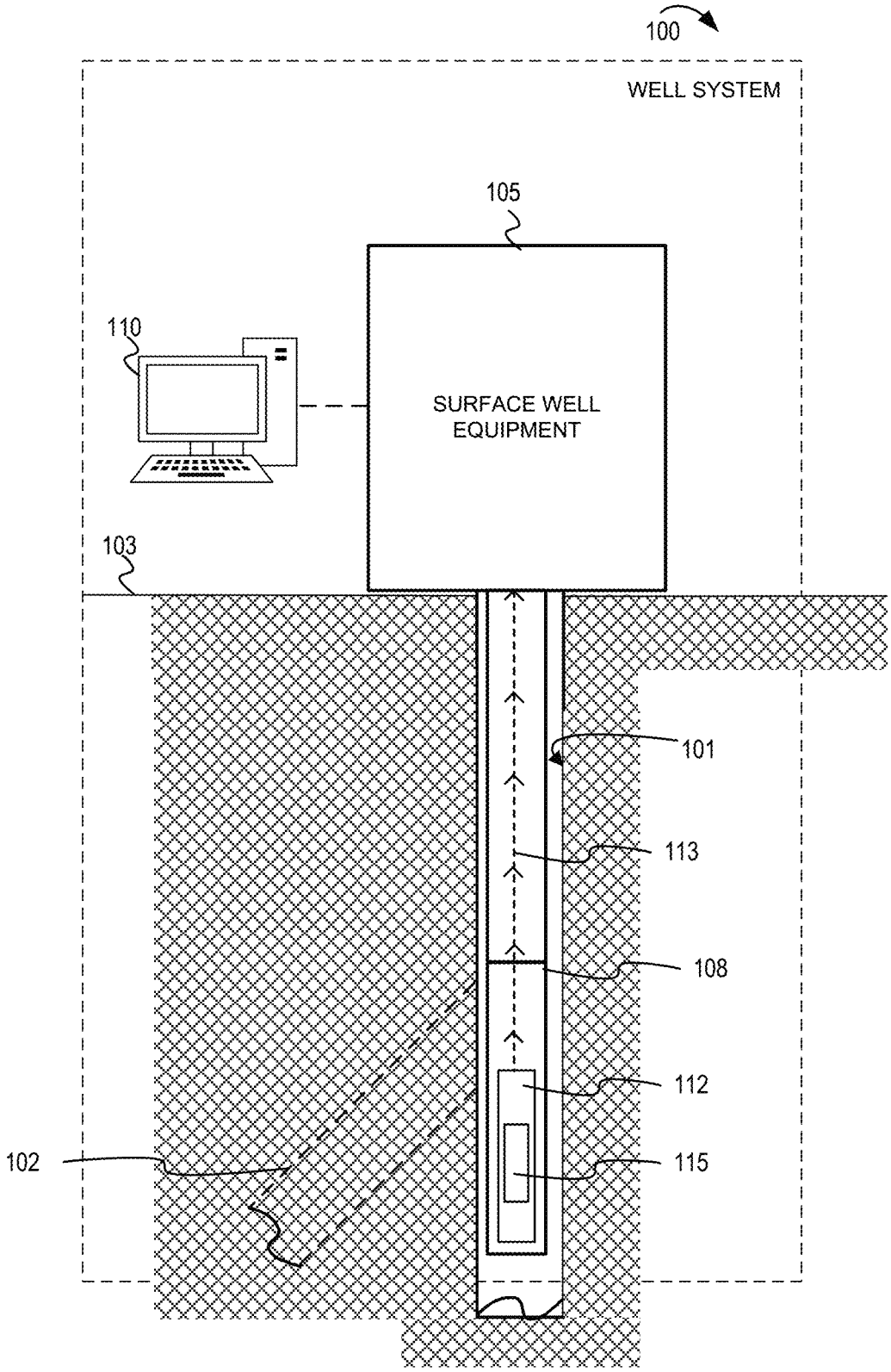
FIG. 1 depicts a schematic diagram of an example well system including a downhole test apparatus that can test whether a downhole well device performed a function and can provide an indication to the surface whether the function was completed successfully, according to some implementations.

The description that follows includes example systems, methods, techniques, and program flows that describe aspects of the disclosure. However, it is understood that this disclosure may be practiced without these specific details. For instance, this disclosure refers to operations performed using well systems at well sites, such as multilateral operations or sidetracking operations in illustrative examples. A multilateral operation pertains to creating a well that has more than one branch radiating from the main wellbore. Likewise, sidetracking refers to drilling a secondary wellbore away from an original wellbore. A sidetracking operation may be done to bypass an unusable section of the original wellbore or explore a geological feature nearby. Aspects of this disclosure can be applied to other types of remote operations where the tools, operations, processes are separated from the operators by distances, barriers, adverse environments, etc. The ability to remotely test to determine or verify whether functions were performed successfully and then communicate or report the tests results to a locale inhabitable by humans (e.g. the earth's surface) makes this disclosure suitable for use in other remote locations with harsh environments such as outer space (e.g., satellites, spacecrafts, etc.), aeronautics (aircrafts, drones), on-ground (swamps, marshes, power generation, hydrogen or other gas extraction and/or transportation, etc.), below ground (mines, caves, etc.), ocean (on surface and subsea), subterranean (mineral extraction, storage wells (carbon sequestration, carbon capture and storage (CCS), etc.)), and other energy recovery activities (geothermal, steam, etc.). The unhabitable environments may comprise corrosive fluids (hydrocarbons, H2S fluids, CO2 fluids, acids, bases, gases, etc.), contaminants (sand, debris, paraffins, asphaltenes, etc.), high-temperature fluids (fluids from geothermal formations, injected fluids, etc.), cryogenic fluids, etc. The inventions disclosed within may be utilized in harsh conditions (e.g., corrosive environments or contaminated fluids), extreme pressures (e.g., >5,000-psi differential), extreme temperatures (e.g., >−20° F. or >300° F.), etc. In other instances, well-known instruction instances, protocols, structures, and techniques have not been shown in detail to avoid confusion.

Various innovative aspects of the subject matter described in this disclosure for implementing an apparatus, system, and method for performing a downhole test of completion of a function performed by a downhole well device in a well system and communicating the test results to the surface. In some implementations, a downhole well device or tool may perform a function, and a downhole test apparatus may perform a downhole test to determine whether the function was completed or performed successfully, as further described in FIGS. 1-10. The function may be a setting function, an actuating function, or an anchoring function, among others, or any combination thereof. For example, the setting function or the actuating function may be to set, position, or actuate one or more devices or mechanisms including, but not limited to packer elements or other sealing elements of the downhole well tool or device. An anchoring function may be to anchor the downhole well tool or device. The anchoring function may comprise engaging one or more components, devices, or mechanisms to one or more other components, devices, or mechanisms to limit the relative movement of systems, components, devices and/or mechanisms. In some implementations, the downhole test apparatus may provide an indication from downhole to the surface, such as to the surface well equipment, to indicate or verify or report the results of the downhole test, such as whether the function was completed or performed successfully, as further described in FIGS. 1-10.

FIG. 1 depicts a schematic diagram of an example well system 100 including a downhole test apparatus that can test whether a downhole well device performed a function and can provide an indication to the surface whether the function was completed successfully. In some implementations, the well system 100 may include surface well equipment 105, a drill string 108, and a computer system 110. The drill string 108 may include a downhole well tool 112 and a downhole test apparatus 115. The drill string 108 may also be referred to as a work string. Although not shown for simplicity, the drill string 108 may also include other sections or components, such as a drill pipe and a bottom hole assembly. In some implementations, the downhole well tool 112 and the downhole test apparatus 115 may be part of the bottom hole assembly. In some implementations, the drill string 108 may have more than one downhole well tool 112. The drill string 108 may be lowered below the surface 103 (or downhole) within the wellbore 101. In some implementations, the wellbore 101 may be a single, main wellbore. In some implementations, the wellbore 101 may be a multilateral wellbore having at least one wellbore branch 102 (or lateral wellbore) that radiates from the main wellbore. In some implementations, the well system 100 may be any type of oil and gas well systems, such as drilling, production, workover, and completion well systems. In some implementations, the surface well equipment 105 may be any type of surface well equipment that are used in well systems, such as sensors (pressure sensors, temperature sensors, etc.), data collection systems, power generation systems, surge tanks, transfer pumps, separators, multi-phase flow meters, choke manifolds, chemical injection pumps, solids collection systems, mud pumps, pump trucks, water tanks, among others. In some implementations, the computer system 110 may be considered part of the surface well equipment. In some implementations, the type of surface well equipment 105 that is included in the well system 100 may depend on the type of well system 100.

In some implementations, the downhole well tool 112 (which may be generally referred to as a downhole well device) may perform a downhole function. The downhole test apparatus 115 (which may also be referred to as a downhole test assembly) may perform a downhole test to determine whether the downhole function was completed or performed successfully. The downhole test apparatus 115 may provide an indication 113 from downhole to the surface 103, such as to the surface well equipment 105, to indicate or verify or report the results of the downhole test, such as whether the downhole function was completed or performed successfully or unsuccessfully. In some implementations, the downhole well tool 112 may be a whipstock, a packer, an anchor, a whipstock and packer combination, or a whipstock and anchor combination, among others, and any combination thereof. In some implementations, the downhole function of the downhole well tool 112 may be a setting function, an actuating function, or an anchoring function, among others, or any combination thereof. For example, the setting function or the actuating function may be to set or actuate packer elements or other sealing elements of the downhole well tool 112. As another example, the anchoring function may be to anchor the downhole well tool 112 to the wellbore 101, such as to the casing of the wellbore 101. In some implementations, the downhole test apparatus 115 may include one or more of electronics, sensors, motors, pumps, valves, switches, timers, microcontrollers, microcomputers, batteries, and logic devices, among others (or any combination thereof), that can perform a downhole test to determine whether the downhole function was completed. For example, the downhole test may be a downhole seal test to determine whether the setting function or the actuating function for the packer elements or other sealing elements of the downhole well tool 112 was completed. As another example, the downhole test may be a downhole anchor test to determine whether the anchoring function for an anchor element (such as anchoring slips) of the downhole well tool 112 was completed. In some implementations, the downhole test apparatus 115 be located within the downhole well tool 112. In some implementations, the downhole test apparatus 115 may be partially located within the downhole well tool 112 and partially located within a different downhole well device or tool, or may be completely located within a different downhole well device or tool, or may be located in another section of the drill string 108. In some embodiments, the setting, actuating, anchoring, or other function may occur, partially or in whole, at a distance from final location of the downhole well tools. For example, the function, may partially or in whole, may occur at the surface, for example in an assembly shop. In some implementations, the anchoring function may comprise engaging one or more components, devices, or mechanisms to one or more other components, devices, or mechanisms to limit the relative movement of systems, components, devices and/or mechanisms. Examples of some anchoring devices may include slips (wedges or other shaped components) with serrated edges, protrusions, etc. that may be moved in contact with another one or more system, component, device and/or mechanism to limit or prevent relative movement. The engagement may be permanent or releasable (non-permanent). Other examples of some anchoring devices may include ratcheting mechanisms, ratch-latch mechanisms, collets, collets with features to improve the anchoring or other function(s) of the system(s), keys, dogs, lugs, biased devices, directional anchoring devices (e.g., axial and/or rotational), j-slot devices, other protrusion and slot/groove devices, etc.

In some implementations, the downhole test apparatus 115 may provide various types of indications 113 (which also may be referred to as signals or communications) to the surface well equipment 105 to indicate or verify the results of the downhole test, such as whether the downhole function was completed or performed successfully. For example, the indication 113 (e.g., a signal or any type of communication) may include at least one of various types of indications (or indication types), such as at least one of a pressure change indication, a flow change indication, an electrical signal or electrical indication, an acoustic indication, a vibrational indication, a mechanical indication, a wireless signal or indication (such as Wi-Fi), a light signal (such as fiber optic) or indication, a temperature change indication, a time change indication, a position change indication, a magnetic change indication (e.g., such as a change in magnetic strength, direction or presence), an inductive change indication, a conductive change indication, a stress change indication, a strain change indication, a force change indication (or a change in resistance to a force), a gamma ray change indication, a radioactive change indication, an energy level change indication, a change in a property of a mass, a change in a property of a fluid, a change in a property of a gas, among others, or any combination thereof. For example, the downhole test apparatus 115 may perform a downhole seal test using pressure (which may be referred to as a downhole pressure test), and the downhole test apparatus 115 may provide a pressure change indication to the surface 103 indicating whether the packer elements or sealing elements were set or actuated successfully or unsuccessfully, as further described below in FIG. 2. As another example, the downhole test apparatus 115 may perform a downhole anchor test using an electrical or mechanical device, and the downhole test apparatus 115 may provide an electrical, mechanical, light, or pressure indication to the surface 103 indicating whether the anchoring elements (such as anchoring slips) were anchored successfully or unsuccessfully. For example, a small movement of the anchor slips (or anchor teeth) engaging the casing may be monitored. Based on the amount of mechanical movement, an electrical signal may be transmitted to a solenoid to change an orifice size, which may result in a pressure change that is detected at the surface. As another example, based on the amount of mechanical movement of the anchor slips or teeth, an electrical signal may be transmitted to a laser or light or inductive switch to transmit a signal to a fiber optic cable, an electrical cable, or a wired drill pipe or work string. In some implementations, the surface well equipment 105 may present the test results, such as whether or not the downhole function was completed successfully, to the operator of the well system 100. For example, the test results may be presented on a display on the surface well equipment 105 or on the computer system 110 connected to (or integrated within) the surface well equipment 105.

In some implementations, the indications (such as the indication 113) from downhole to the surface may be one-way communications (which may be referred to as unidirectional communications). In some implementations, the indications (such as the indication 113) may be provided or communicated bidirectionally (e.g., from downhole to the surface and from the surface to downhole) and thus may be referred to as bidirectional indications. In some implementations, the surface well equipment 105 may provide or communicate an indication (not shown) to a downhole well tool (such as the downhole well tool 112 or the drill string 108) or any other device or component of the well system 100. As described above, the indication (e.g., a signal or any type of communication) provided by the surface well equipment 105 may include at least one of various types of indications (or indication types), such as at least one of a pressure change indication, a flow change indication, an electrical signal or electrical indication, an acoustic indication, a vibrational indication, a mechanical indication, a wireless signal or indication (such as Wi-Fi), a light signal (such as fiber optic) or indication, a temperature change indication, a time change indication, a position change indication, a magnetic change indication (e.g., such as a change in magnetic strength, direction or presence), an inductive change indication, a conductive change indication, a stress change indication, a strain change indication, a force change indication (or a change in resistance to a force), a gamma ray change indication, a radioactive change indication, an energy level change indication, a change in a property of a mass, a change in a property of a fluid, a change in a property of a gas, among others, or any combination thereof. For example, the surface well equipment 105 may provide a pressure change indication to the downhole well tool 112 or the downhole test apparatus (or both) by pumping down the drill string 108 or an annulus (or both), or by changing the flow of the fluid being pumped downhole. As another example, the surface well equipment 105 may provide a mechanical indication or a force change indication from the surface to downhole by changing the weight or torsion provided down the drill string 108, such as by pushing, pulling, applying torsion, or lowering the drill string 108. As another example, the surface well equipment 105 may transmit power (or any form of energy) downhole to one or more downhole well tools (such as the downhole well tool 112) or to one or more downhole test apparatus (such as the downhole test apparatus 115), or both. It is noted, however, that in some embodiments a power supply may be located downhole (e.g., as part of the drill string 108) or part of the downhole test apparatus 115, or part of another string, another component, etc. In some embodiments, the power supply may include one or more of a battery, a pump, a transformer, a transducer, insulation (electrical or heat or both), and an electrical conductor. In some implementations, if the surface equipment 105 receives an indication (such as the indication 113) that the downhole function was not completed or performed unsuccessfully, the surface well equipment 105 may provide one of the indications described above to the downhole well tool 112 or the downhole test apparatus 115 to redo the downhole function, redo the downhole test, or redo both the downhole function and the downhole test. For example, the surface well equipment 105 may increase the flow of the pumped fluid, which can be detected downhole as a pressure change indication and can cause the downhole function (e.g., setting one or more sealing elements or engaging one or more anchors) to be performed again, or the downhole test to be performed again, or both. As another example, the surface well equipment 105 may increase the weight or torsion that is placed on the drill string 108, which may be detected downhole as a mechanical or force change indication and can cause the downhole function (e.g., setting one or more sealing elements or engaging one or more anchors) to be performed again, or the downhole test to be performed again, or both.

In some implementations, the indication 113 that is provided from downhole to the surface may start out as a first type of indication that is then translated or converted to a second type of indication before reaching the surface. The indication 113 may still communicate the same information (i.e., whether the downhole function was successful or unsuccessful) to the surface even when the indication 113 is translated or converted from the first indication type to the second indication type. Each of the first indication type and the second indication type can be any of the indication types listed above. In some implementations, the indication 113 of the first indication type can be generated by, or based on actions performed by, a first downhole well tool and provided to a second downhole well tool. The second well tool may translate the indication 113 of the first indication type into a second indication type, and the indication 113 of the second indication type may be provided to the surface. For example, the indication 113 of a first indication type (e.g., such as a pressure change indication) can be provided from the downhole test apparatus 115 of the downhole well tool 112 to a second downhole well tool, and the second downhole well tool can translate or convert the indication 113 from the first indication type to a second indication type (e.g., such as an electrical signal indication) that is provided to the surface. As another example, the indication 113 of a first indication type (e.g., such as an electrical signal indication or a time change indication) can be provided from the downhole test apparatus 115 of the downhole well tool 112 to a second downhole well tool, and the second downhole well tool can translate or convert the indication 113 from the first indication type to a second indication type (e.g., such as a mechanical indication or a pressure change indication) that is provided to the surface. It is noted, however, that in some implementations the indication 113 can be converted or translated two or more times into three or more indication types before reaching the surface. For example, the first indication type may be translated or converted to a second indication type, and then the second indication type may be translated or converted to a third indication type, etc. Furthermore, as described previously, it is noted that the indication 113 can remain a single type of indication until it reaches the surface. For example, the indication 113 of the first indication type (e.g., such as a pressure change indication) can be generated by, or based on actions performed by, a first downhole well tool and provided to a second well tool. The second well tool may provide the indication 113 of the same indication type, i.e., the first indication type (e.g., such as a pressure change indication), to the surface. In some implementations, each of the first downhole well device and the second downhole well device may be a certain type of downhole well device (or downhole well device type). The various downhole well device types may include a packer, an anchor, a whipstock, a drill string or workstring, a running tool, a retrieval tool, a fishing tool, a reservoir test tool, a perforating tool, a workover tool, a logging tool, a coring tool, a sample retrieval tool, and a plug, as further described below.

In some implementations, the downhole well tools (e.g., such as the downhole well tool 112) may be deployed on a variety of devices, such as a workstring, electric wireline, coiled tubing, slickline, etc. Therefore, it is noted that when the phrase "drill string" is used (e.g., such as drill string 108), it may be referring to a drill string, a workstring, an electric wireline, a tubing string, a coiled tubing string, an electrical slickline (e-line), a slickline, a drill rod, and/or other devices (i.e. fiber optic cable), and/or a combination of two or more devices (i.e. drill string with an electrical line; known as wired pipe). The devices may be comprised of a single material (e.g., steel) or a combination of materials (i.e., carbon fiber and steel). A drill string (or any embodiment of a string or line that may be used to convey tools from a distance) may be used as a first downhole well device, a second downhole well device, or a downhole well device. A drill string, in general, may be comprised of joints of drill pipe with threads at each end which may be connected together to create the drill string. The joints of drill pipe may be various lengths, e.g., typically the joints of drill pipe may be 30-foot to 42-foot long, but other lengths may be used. In some implementations, the joints of drill pipe may be hollow so fluid may be pumped through them. Other strings of threaded pipes may be used too; those strings may comprise tubing, casing, liner joints, etc. A drill string may comprise other components to aid or enhance the creation and transfer of indicator type(s), etc. A drill string may comprise other components to create and/or provide (transmit) indication type(s) such as a downhole test apparatus (e.g., such as the downhole test apparatus 115) and/or a shuttle valve (e.g., such as the shuttle valve 540 shown in FIG. 4), etc. In some implementations, a drill string (e.g., such as the drill string 108) may perform at least one or more of the following operations described below. First, the drill string may create an indication (e.g., such as indication 113) of a first indication type by changing the size of a flow path. The size of the flow path may be changed by moving one or more components that comprise the flow path, so the size of the flow path is changed (i.e., a solenoid valve, a metering valve, a sliding valve, a choking valve, a relief valve, a dump valve, etc.). Second, the drill string may provide the first indication type to a second well device. For example, a pressure change or a flow change may provide the first indication type to a second well device. The indication of the first indication type (e.g., a pressure or flow change) may be transferred via a small diameter tube (e.g., such as the control line 230 of FIG. 2). Third, the drill string may create the indication of a second indication type. For example, a change in piston areas may be used to shift a valve or other device to open a second flow path. For example, like a hydraulic jack, a small input pressure acting on a larger piston area results in a large force capable of shifting a sliding, shuttle, or other type of valve (e.g., such as the shuttle valve 540 of FIG. 5). Fourth, the drill string may provide the indication of the second indication type to the surface or other locales. In some implementations, one or more of the downhole well tools may be released from the workstring or drill string, and left in the well. In some implementations, a communication line (such as the control line 230 in FIGS. 2-7) may be used to transmit data, power, downhole test results from the downhole well tool being left downhole to the workstring or drill string that will be pulled out of the hole (POOH).

As described above, in some implementations, an electric wireline may be utilized as the drill string in the well system 100. The electric wireline may comprise one or more electric conductors (wires) that can pass electrical signals to provide an indication (e.g., such as the indication 113) of a first indication type to a second well device and/or to provide the indication (e.g., such as the indication 113) of a second indication type to the surface. An electric wireline may comprise components to create a first or second indication type. For example, an electric wireline may create an electrical indication, such as a changing voltage level, by opening or closing an electrical switch. Therefore, an electric wireline can provide electrical signals to perform one or more of: 1) create a first indication type, 2) provide a first indication type to a second well device, 3) create a second indication type, and 4) provide a second indication type to the surface. In some implementations, a coiled tubing string may function like a drill string by providing fluid pressure and/or flow indications to perform one or more of the following: 1) create a first indication type, 2) provide a first indication type to a second well device, 3) create a second indication type, and 4) provide a second indication type to the surface. A coiled tubing string may comprise other components including components to create and/or provide (transmit) an indication (e.g., such as the indication 113) of one or more indication types, such as a downhole test apparatus (e.g., such as the downhole test apparatus 115) and/or a shuttle valve (e.g., such as the shuttle valve 540 of FIG. 5), etc. In some implementations, a slickline may be used, which is typically a thin steel solid wire contained on a spool. The slickline may be continuously unspooled (deployed) from the spool into a well. The slickline may use movement of the line, changes in momentum of the line, a tensile force on the line to do one or more of the following: 1) create a first indication type, 2) provide a first indication type to a second well device, 3) create a second indication type, and 4) provide a second indication type to the surface. A slickline may comprise other components including components to create and/or provide (transmit) an indication (e.g., such as the indication 113) of one or more indication types, such as a downhole test apparatus (e.g., such as the downhole test apparatus 115) and/or electronic/electrical components for sensing and communication. In some implementations, an electrical slickline may be used, which is similar to a slickline but typically has at least an electrical insulation jacket to prevent electricity from passing unintentionally from the metal core to an electrical ground. In some implementations, an electrical slickline may function like an electrical wireline by providing one or more electrical signals/indications to 1) create a first indication type, 2) provide a first indication type to a second well device, 3) create a second indication type, and 4) provide a second indication type to the surface. An electrical slickline may comprise other components including components to create and/or provide (transmit) an indication (e.g., such as the indication 113) of one or more indication types, such as a downhole test apparatus (e.g., such as the downhole test apparatus 115) and/or electronic/electrical components for sensing and communication. In some implementations, a drill rod may be used, which is similar to a drill pipe but may be shorter to work in constrained areas. In some implementations, the drill rod may not have a hole in the center for circulating fluid. A drill rod, as well as a drill string, may use axial movement (i.e. up and down), rotational movement, a tensile and/or compression force, etc. or a combination of one or more manipulations to do one or more of the following: 1) create a first indication type, 2) provide a first indication type to a second well device, 3) create a second indication type, and 4) provide a second indication type to the surface. A drill string comprised of drill rod may also be comprised of other components to aid or enhance the creation and transfer of an indication (e.g., such as the indication 113) of one or more indication types, etc. A drill string may comprise other components to create and/or provide (transmit) the indication of one or more indication types, such as a downhole test apparatus (e.g., such as the downhole test apparatus 115) and/or an electromagnetic signal transmitter, etc.

As described above, in some implementations, a running tool may be used in the well system 100, which is a tool used to run (deploy) one or more other tools/devices into a well. The running tool, in part or in whole, may be pulled out of the well after it has deployed the other tool(s) in a wellbore (e.g., such as wellbore 101). For example, permanent packers (packers not intended to be easily removed from a wellbore) are often deployed on a running tool. In some implementations, the running tool may comprise a hydraulic piston that can be used to set the slips (e.g., extend the anchoring mechanism into an interference fit with the casing) and/or compress the packer elements (seals) to provide a pressure barrier. The components of the running tool (e.g., hydraulic piston, hydraulic cylinder, etc.) are not part of the permanent packer, which allows the packer to have a larger inside diameter or bore for allowing more fluid to flow through the packer. In some implementations, by using a running tool, a large polished (smooth) bore tubular device may be ran in concert with the packer. The polish bore tubular may be identified as a Polish Bore Receptacle (PBR) and may be used to land (install) and engage a seal assembly after the running tool has been pulled from the well. A seal assembly may be run at the lower end of another string of tubing identified as a production tubing string. A production tubing string may provide an isolated (scaled) flow path for the production of fluids through its internal bore. The PBR and seal assembly provide a pressure-tight seal at the distal end of the production tubing string. In some implementations, a running tool may comprise sensors, switches, indicators, shearing devices, dogs, clutches, batteries, generators, electronic devices and/or other mechanisms that can be used to perform one or more of the following: 1) create a first indication type, 2) provide a first indication type to a second well device, 3) create a second indication type, and 4) provide a second indication type to the surface. In some implementations, the indication (e.g., such as the indication 113) of the first indication type may be generated or created, for example, by measuring strain on a load cell via a first computer system (e.g., such as the computer system 1200 of FIG. 12, etc.) and/or a downhole test unit (e.g., the downhole test apparatus 115, the downhole test unit 1213, etc.). The first type of indication may be provided to a second well device via a communication module (e.g., such as the communication module 1208 of FIG. 12), for example, by transmitting an electrical signal to a second computer system (e.g., such as computer system 1200) mounted (affixed, or a part of) the running tool. The indication of the second indication type may be generated or created, for example, by a pressure drop created by the running tool's computer system (e.g., such as computer system 1200) via its device control unit (e.g., such as device control unit 1211) actuating a valve to open an orifice inside of the running tool or drill string. The second indication type may be provided to the surface by controlling the magnitude and duration of the pressure drop so that it will be detectable at the surface. It is noted that a variety of running tools may be used, and running tools may be utilized with a drill string, a tubing string, an electrical wireline, a slickline, an e-line, a coiled tubing string, wired drill pipe, etc. or a combination thereof. A running tool may be attached to the distal end of a workstring or drill string, which may be referred to as a Bottom Hole Assembly (BHA). The running tool may be run together with other tools and devices; some which may enhance the generation and transfer of indicator types as disclosed herein in present disclosure.

As described above, in some implementations, a retrieval tool may be used to retrieve one or more other tools/devices/objects from a well. A retrieval tool (which also may be referred to as a retrieving tool) may comprise sensors, switches, indicators, shearing devices, dogs, clutches, batteries, generators, electronic devices, valves, orifices, and/or other mechanisms that can be used to do one or more of the following: 1) create a first indication type, 2) provide a first indication type to a second well device, 3) create a second indication type, and 4) provide a second indication type to the surface. In some implementations, the above operations may enhance the reliability of retrieving items from a wellbore (e.g., such as wellbore 101). In some embodiments, the retrieval tool may have one or more features, including those shown in FIG. 12. In some embodiments, the retrieval tool may interface and/or transfer data between one or more other tools/devices/objects in the wellbore including those that it will be retrieving. For example, there may be a wireless electromagnetic energy exchange between the retrieval tool/retrieving system and with the one or more tools/devices/objects in the wellbore. The electromagnetic energy exchange may provide power/energy to the one or more tools/devices/objects in the wellbore to charge a battery, a capacitor, a super-capacitor, etc. The electromagnetic energy exchange may provide data transfer from the one or more tools/devices/objects in the wellbore to the retrieval tool/retrieving systems. The energy and/or data exchange may be unidirectional, bi-directional, synchronous, asynchronous, etc. It is noted that a variety of retrieval tools may be used, and the retrieval tools may be utilized with a drill string, a tubing string, an electrical wireline, a slickline, an e-line, a coiled tubing string, wired drill pipe, etc. or a combination thereof. A retrieval tool may be attached to the distal end of a workstring or drill string (e.g., such as the BHA). The retrieval tool may be run together with other tools and devices; some which may enhance the generation and transfer of indicator types as disclosed herein in present disclosure.

As described above, in some implementations, a retrieval tool may be a fishing tool or a fishing tool assembly. In some embodiments, a fishing tool may be used to retrieve tools/devices/objects unintentionally left or dropped in a well or wellbore (e.g., such as the wellbore 101). For example, a drill string may become parted (separated) unintentionally or a roller cone from a drill bit may dislodge from the drill bit. Other examples may include items accidentally dropped into the well for the surface; for example, a tong die may be dropped for the rig floor into the well. In some implementations, a fishing tool may provide one or more of the following operations to enhance the reliability of retrieving (e.g. fishing) items from a wellbore: 1) create a first indication type, 2) provide a first indication type to a second well device, 3) create a second indication type, and 4) provide a second indication type to the surface. The well operator may utilize the indication (e.g., such as the indication 113) of the at least one indication type when the retrieval tools/fishing tool has engaged (captured/caught) the tools/devices/objects (i.e., fish) unintentionally left or dropped in a well or wellbore. By employing operations and features (i.e., processes, devices, systems) described herein in this disclosure, sensors of one or more types and configurations may be utilized to communicate to the surface if a retrieval tool/fishing tool has engaged (captured/caught) the tools/devices/objects. In some implementations, in addition to determining if the fishing tool has engaged the tools/devices/objects, the sensors may be used to determine whether the expected weight of the tools/devices/objects has been engaged. In a deviated well or horizontal well, there may be significant friction and drag that prevents determining how much weight is being retrieved by the fishing tool. However, by utilizing the sensors and other operations and features described herein, the amount of weight of the tools/devices/objects that are engaged may be determined. If the determined weight matches the expected weight, an indication may be provided to the surface that the tools/devices/objects have been successfully engaged. There are a variety of fishing tools that may be used, which include, but are not limited to: magnet, junk baskets (including core type junk baskets, boot baskets, etc.), mills (including tapered mills, flat mills, etc.), washover pipe, overshot, pipe spear, wireline spear, jars, etc. A fishing tool may be attached to the distal end of a workstring or drill string (e.g., such as the BHA). The fishing tool may be run together with other tools and devices; some which may enhance the generation and transfer of indicator types as disclosed herein in present disclosure.

As described above, in some implementations, a reservoir test tool may be used in the well system 100, which is a tool that may be utilized to evaluate one or more properties of the reservoir of interest. For example, the pressure, permeability, and productive capacity of a geological formation (e.g., reservoir). The test is a valuable way of obtaining information about the formation fluids and a hydrocarbon reservoir. There are a variety of ways to conduct a reservoir test including performing the test using a drill string, a tubing string, a coiled tubing string, a wireline, etc. A reservoir test (which may be referred to as a formation test, fluids test, etc.) often comprises setting seals similar to packer elements across the zone of interest (the portion of the formation/reservoir the operator is interested in evaluating). Also, the test may comprise measuring pressures, capturing samples of fluids, measuring the flow of fluids (i.e., a draw-down test), measuring temperature, measuring ratio of gas to fluids, etc. Other tests of a reservoir or formation may utilize the features described herein in this disclosure, including, but not limited to a leak-off pressure test (which is defined as the pressure at which the fluid will leak into the formation and it is equal to the minimum horizontal stress), extended leak-off test, formation integrity test where drill stinge or wellbore pressure increases until it reaches the required pressure to test the strength of the formation, without the intention of breaking the rock. By utilizing the operations and features (i.e., processes, devices, systems) described herein in this disclosure, a reservoir test can monitor and control one or more of these operations/tests/parts-of-test or operations and relay information to the surface. A reservoir test tool and/or reservoir test system comprising one or more testing devices can improve the reliability, increase the safety of reservoir tests, and provide data to the surface quickly in a cost-effective way. In some implementations, a reservoir test tool and/or reservoir test system that utilizes the operations and features (e.g., processes, devices, systems) described herein in this disclosure may perform one or more of the following: 1) create one or more first indication types, 2) provide one or more first indication types to a second well device or devices, 3) create one or more second indication types, and 4) provide one or more second indication types to the surface. The indication (e.g., such as the indication 113) of the one or more indication types may include the indication types described herein in this disclosure. A reservoir test tool may be attached to the distal end of a workstring or drill string (which may be referred to as a BHA) or further uphole from the distal end of the workstring or drill string. The reservoir test tool may be run together with other tools and devices; some which may enhance the generation and transfer of indicator types as disclosed herein in present disclosure.

As described above, in some implementations, a perforating tool and/or perforating system may be used, which is a tool or system that is utilized to create holes (perforations) into a tubular (casing, tubing, liner, etc.) and/or reservoir, or into another tool/device. In some implementations, the perforations are to allow hydrocarbons to flow from the reservoir into the inside of a tubular (i.e., tubing, casing, or liner). In some implementations, the perforations are to allow fluids to be injected and/or disposed into a formation. In some implementations, a perforating tool and/or perforating system that implement the operations and features described in this disclosure may provide one or more of the following to enhance the performance of a perforating operation which may lead to better perforations (i.e., ideal holes positioned in the optimal orientation and depth, etc.) to improve production of hydrocarbons, etc. 1) create a first indication type, 2) provide a first indication type to a second well device, 3) create a second indication type, and 4) provide a second indication type to the surface. By utilizing the operations and features (e.g., processes, devices, systems) described herein in this disclosure, the performance of the perforating tools/systems and the results of a perforating operation can be recorded and transmitted to surface to be analyzed and studied. Depending upon the analysis, backup perforating charges may be detonated, for example, if additional perforations are desired or if certain perforations need to be re-shot due to a misfire of the first shot. In some implementations, one or more parameters may be measured and transmitted to surface (e.g., via the indication 113 of one or more indication types) to aid in increasing the reliability of the perforating tool and/or perforating system and/or increasing the productivity of the well. Some parameters that may be measured and transmitted include, but not limited to, accelerations due to firing of a charge (or charges) (typically a successful charge will generate larger accelerations than a charge that misfires (or doesn't fire at its highest capacity)), pressure waves, sonic waves, impulses, orientation, seismic readings and other readings to quantify the depth and geometry of a perforation/perforation tunnel. Other parameters may include fluid properties (the properties of the fluid inside the tubular may change as fluids (i.e., hydrocarbons) enter the tubing via perforations. For example, this may be described as an under-balanced scenario where the formation pressure prior to perforation is greater than the hydrostatic pressure inside the tubular. Typically, the formation fluids will enter the tubing until the pressures are equalized. The perforation may allow the higher-pressure fluid to exit into the formation or the fluid in the tubing exits through the tubular (such as an over-balanced scenario where the hydrostatic pressure inside the tubular is higher than the formation pressure prior to perforation). There may be a variety of perforating guns and device that may be used, including but not limited to, the following types: an expendable gun, a semi-expendable gun, a retrievable hollow carrier gun, a casing gun, a tubing conveyed gun, a thru-tubing guns, among others, or a combination thereof. Manufacturing, designing and the use of perforating tools/systems comprising one or more testing devices can improve the reliability, performance of perforation operations plus provide data to the surface quickly in a cost-effective way. A perforating tool and/or system is typically attached to the distal end of a workstring or wireline or drill string, or it may be further uphole from the distal end of the workstring or drill string. In some implementations, more than one perforating tool and/or system are run on a single trip. The perforating tool and/or system may be run together with other tools and devices; some which may enhance the generation and transfer of indicator types as disclosed herein in present disclosure.

A workover operation is any operation performed on, within, or through the wellbore (such as the wellbore 101) after the initial completion. A workover operation may be performed for various reasons, including due to unsatisfactory production or injection rates (e.g., reservoir inflow and/or outflow problems may be corrected), regulatory requirements (e.g., isolate pressures and/or install safety equipment), reservoir data gathering (e.g., reservoir management may include reservoir data gathering of information such as pressures, fluid samples, and zonal productivity/injection tests), and abandonments (e.g., squeeze cement, retrieve production equipment, setting a plug, cutting and pulling casing and other tubulars), among others. In some implementations, workover operations and the tools/systems used to perform workovers may include sensors, switches, indicators, shearing devices, dogs, clutches, batteries, generators, electronic devices and/or other mechanisms, etc. that can be used to perform one or more of the following: 1) create a first indication type (for example, by monitoring a position of a device and/or measuring the contents of a fluid and/or measuring a downhole pressure via a first computer system (e.g., such as the computer system 1200 of FIG. 12) and/or a downhole test unit (e.g., the downhole test apparatus 115, the downhole test unit 1213, etc.), 2) provide a first indication type to a second well device via a communications module (e.g., such as the communication module 1208), for example, transmit one or more electrical signals (i.e. related to the position of a device and/or to the contents of a fluid and/or to measurement of a downhole pressure) to a second computer system (e.g., such as the computer system 1200) mounted (affixed, or a part of) the running tool, 3) create a second indication type (e.g., such as another electrical signal created by the running tool's computer system (e.g., such as the computer system 1200) via its device control unit (e.g., such as the device control unit 1211) actuating a valve to open an orifice between the inside of the running tool or drill string), and 4) provide the second indication type to the surface (e.g., by controlling the magnitude and duration of the pressure drop so that it will be detectable at the surface). The workover tools and systems may include one or more of the following: a drill string, a tubing string, an electrical wireline, a slickline, an e-line, a coiled tubing string, wired drill pipe, etc. or a combination thereof. In some implementations, the components, devices, systems, etc. associated with the workover operations and the workover tools/systems that are used to create and transmit the indication (e.g., such as the indication 113) of the one or more indication types to the surface may be located in one or more tools (stimulation tool and/or conveyance string component (i.e. joint of drill pipe or similar threaded component or a drill string)), one or more systems (fracturing system) and workstring (i.e. drill string). A workover tool and/or system may be attached to the distal end of a workstring or wireline or drill string. The workover tool and/or system may be run together with other tools and devices; some which may enhance the generation and transfer of indicator types as disclosed herein in present disclosure.

As described above, in some implementations, logging tools may be used in a well system (e.g., such as the well system 100). After casing is installed in a well, logging tools may be deployed to evaluate the integrity of the completion. Such logging tools and evaluations (which may be referred to as surveys) may include production logs and mechanical integrity instruments. Production logs may be used to evaluate fluid production and movement both inside and outside of the casing downhole. The production logging tools may be small in diameter and can be run through tubing for evaluation of the well as it is producing. Mechanical integrity instruments, which assess the condition of the casing or cement around it, are generally larger in diameter. In some implementations, the operations and features (e.g., processes, devices, systems) described herein in this disclosure may be utilized in conjunction with the logging tools. In some embodiments where the evaluation of fluid movement is performed, the logging tools and systems may benefit from the embodiments described in this disclosure, such as the embodiments involving packer elements, seals, anchors, running and retrieval tools and reservoir test tools. As one example, the operations and features (e.g., processes, devices, systems) described herein in this disclosure may be utilized to set sealing elements associated with a logging tool, such as a production logging tool. The seals may temporarily divert or stop fluid from moving so that additional parameters may be detected. For example, a fluid movement inside the production casing may be monitored between two perforations. Then, a seal or seals may be set between the two perforations and the fluid movement on the outside of the production casing may be monitored. The operations and features (e.g., processes, devices, systems) described herein in this disclosure may be used to test the seal(s) and convey the condition of the seals to the surface (e.g., such as via the indication 113 of one or more indication types). Moreover, the flow information may be provided to the surface. For mechanical integrity instruments, the operations and features (e.g., processes, devices, systems) described herein in this disclosure regarding packer elements, anchors, running, retrieval tools and reservoir test tools may be applicable to logging tools with mechanical integrity instruments. Logging tools may be attached to the distal end of a wireline or workstring or drill string. The logging tools may be run together with other tools and devices; some which may enhance the generation and transfer of indicator types as disclosed herein in present disclosure.

As described above, sample retrieval tools may be used in well systems (e.g., such as the well system 100). Recovering samples from a well can be invaluable in the understanding of the reservoir, the fluids within the reservoir, and the economics of the well. Samples may be fluid samples (as described in the workover operations and tools). Samples may also include core samples of the formation (i.e., the rock, sands, shales, fluids, etc.). Like the other reservoir test tools, the perforating tool, etc., a variety of sensors may be installed to detect when an operation has started, is in process, and/or has ended. These operations may be monitored and information about them may be transmitted to the surface (e.g., such as via the indication 113 of one or more indication types), which may ensure each operational process (or step) is successfully concluded before the next process begins. As an example, the operational steps may comprise of: 1) positioning the coring tool at the proper depth and orientation, 2) setting an anchor to secure the tool's position and orientation, 3) extend the coring tool until in contacts the casing or wellbore, 4) rotate the coring head to begin cutting a core, 5) finish cutting the core, 6) retracting the coring tool, 7) release the anchoring device, and 8) retrieve tool out of wellbore. In each of these operational steps, one or more of the following may occur: 1) create a first indication type, 2) provide a first indication type to a second well device, 3) create a second indication type, and 4) provide a second indication type to the surface. Coring tools may be attached to the distal end of a wireline or workstring or drill string. The coring tools may be run together with other tools, devices, and sensors; some which may enhance the generation and transfer of indicator types as disclosed herein in present disclosure.

Figure 2:
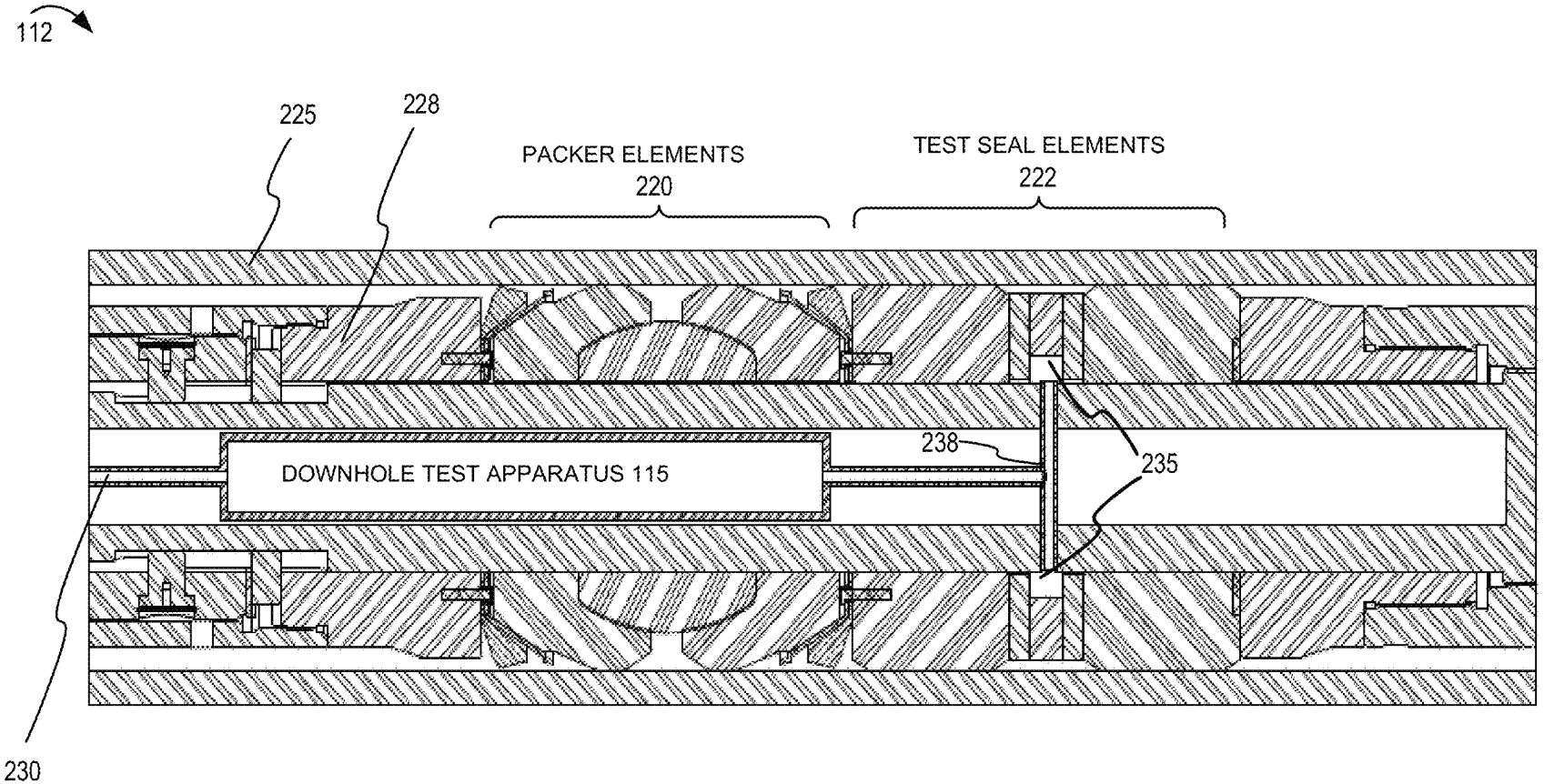
FIG. 2 depicts a schematic diagram of an example downhole well tool or device including a downhole test apparatus that can test whether the downhole well tool or device performed a function and can provide an indication to the surface whether the function was completed successfully, according to some implementations.

FIG. 2 depicts a schematic diagram of an example downhole well tool or device including a downhole test apparatus that can test whether the downhole well tool or device performed a function and can provide an indication to the surface whether the function was completed successfully. As described above, the downhole well tool 112 may be a whipstock, a packer, an anchor, a whipstock and packer combination, or a whipstock and anchor combination, among others, and any combination thereof. FIG. 2 may depict a portion of (or a section of) the downhole well tool 112. In some implementations, the downhole well tool 112 may include packer elements 220 (or any other type of sealing elements) and test seal elements 222. Although not shown, in some implementations, the downhole well tool 112 may include packer elements 220 and does not include any test seal elements 222. In some implementations, the downhole well tool 112 may include a downhole test apparatus 115, a control line 230, pressure ports 235, and pressure lines 238. In some implementations, the pressure lines 238 may connect the downhole test apparatus 115 to the pressure ports 235. As described above, the downhole test apparatus 115 may include one or more of electronics, sensors, motors, pumps, valves, switches, timers, microcontrollers, microcomputers, batteries, and logic devices, among others (or any combination thereof), that can perform a downhole test to determine whether the downhole well tool 112 completed a downhole function successfully. FIG. 2 may depict the portion of the downhole well tool 112 that includes the packer elements 220 and the downhole test apparatus 115. For example, if the downhole well tool 112 is the whipstock and packer combination, the packer elements 220 and the downhole test apparatus 115 may be located in the whipstock portion or in the packer portion (or both portions) of the downhole well tool 112. As another example, if the downhole well tool 112 is the whipstock and anchor combination, the packer elements 220 and the downhole test apparatus 115 may be located in the whipstock portion or in the anchor portion (or both portions) of the downhole well tool 112.

In some implementations, the downhole function performed by the downhole well tool 112 may be the setting or actuating of the packer elements 220. The setting of the packer elements 220 may be performed by various traditional methods, such as by mechanically providing a weight or a compression force, or hydraulically by providing a pressure. For example, a compression force (e.g., from the surface or from the drill string) or a hydraulic pressure (e.g., from pumped fluid) may cause a component 228 (such as a retainer or a piston) or other component of the downhole well tool 112 (or the drill string or both) to press against the packer elements 220 and compress the packer elements 220. When the packer elements 220 are compressed, the packer elements 220 establish a seal with the casing 225 of the wellbore. The packer elements 220 are considered set or actuated when the seal is established with the casing 225. It is noted that the packer elements 220 may be set or actuated by various other methods. In some scenarios, setting packer elements typically implies that the contact pressure between the seal (e.g., packer element, etc.) and the other surface (e.g., casing inner diameter wall, wellbore, Polish Bore Receptacle (PBR), etc.) is greater than the pressure exerted by the fluids in the well. In other words, the contact pressure between the seal and the other surfaces is the amount of pressure the seal generates to resist the bypass of a system pressure. The sealing elements may usually create a seal between itself and two other surfaces. For example, each of the packer elements typically create a seal against the inner diameter of the casing and also between the packer element and the mandrel of the downhole well tool (e.g., as shown in the downhole well tool 112 in FIG. 2).

In some implementations, after the packer elements 220 are set or actuated, the downhole test apparatus 115 may begin the downhole seal test. The downhole test apparatus 115 may detect one or more parameters that indicates when the packer elements 220 are set or actuated. The one or more parameters may also activate the downhole test apparatus 115 to perform the downhole seal test. The one or more parameters may include at least one of a pressure, pressure change, stroke, an electrical signal, or a combination thereof. For example, a pressure may be provided via the control line 230, or an electrical signal may be provided to a microcontroller or microcomputer of the downhole test apparatus 115. The downhole test apparatus 115 may wait a few minutes before starting the downhole seal test to make sure the packer elements 220 are completely set or actuated. For example, the downhole test apparatus 115 may include a timer that can be used to wait a number of seconds or minutes (e.g., such as 3 minutes or 5 minutes) before starting the downhole seal test. The downhole test apparatus 115 may perform the downhole seal test on the test seal elements 222 only, on the packer elements 220 only, or on both the test seal elements 222 and the packer elements 220, or any combination thereof. In some implementations, when the downhole test apparatus 115 performs the downhole seal test on the test seal elements 222, a motor and a pump of the downhole test apparatus 115 may apply a pressure to the pressure lines 238 that are connected to the pressure ports 235 that are between the test seal elements 222. For example, the pump of the downhole test apparatus 115 may pump a fluid (or air or other gas such as nitrogen) to the pressure ports 235 to increase the pressure at the test seal elements 222 (e.g., such as in between the seal elements) in order to pressure test the seal of the test seal elements 222. By testing the seal of the test seal elements 222, the seal of the packer elements 220 may be indirectly pressure tested. For example, if the seal of the packer elements 220 is designed to withstand a first pressure (e.g., such as a pressure of 5,000 psi (or 5 ksi)), the seal(s) of the test seal elements may be tested (e.g., using a pressure sensor) with a second pressure that is higher than the first pressure (e.g., such as a pressure of 6 ksi). In some implementations, when the downhole test apparatus 115 performs the downhole seal test directly on the packer elements 220, a similar downhole seal test may be performed as was described above for the test seal elements. When the packer elements 220 are tested, the test seal elements 222 may not be used, or downhole test apparatus 115 may not be designed to have the test seal elements 222. Similar to the description above, a motor and a pump of the downhole test apparatus 115 may apply a pressure to pressure ports (not shown) that may be located in between the packer elements 220 via pressure lines (not shown). The pump of the downhole test apparatus 115 may pump a fluid (or air) to the pressure ports to increase the pressure at the packer elements 220 (e.g., such as in between the packer elements 220) in order to pressure test the seal(s) of the packer elements 220. In some implementations, both the seal(s) of the test seal elements 222 and the seal(s) of the packer elements 220 may be pressure tested (e.g., using a pressure sensor). It is noted, however, that the seal(s) of the packer elements 220 may be pressure tested in various other ways. For example, the downhole well tool 112 may include a single test seal, and the downhole test apparatus 115 may apply pressure in between the packer elements 220 and the single test seal in order to test the seals of both the packer elements 220 and the single test seal. In another example, the downhole well tool 112 may include a single test seal, and the downhole test apparatus 115 may apply pressure in between the one packer element 220 and the single test seal in order to test the seal of one of the packer element 220 and the single test seal. In some implementations, the test seal elements 222 are adjacent to the packer elements 220. In some implementations, the test seal elements 222 are proximate (or located a certain proximity) from the packet elements 220. In one example, the test seal elements 222 may be located within 4 inches of the packer elements 220. In another example, the test seal elements 222 may be located between 4 inches and 12 inches from the packer elements 220. It is noted, however, that the test seal elements 222 may be located at various other distances from the packer elements 220, such as between 12 inches and several feet from the packer elements 220. It is noted that a variety of types of sensors may be utilized to measure the amount of compression (or squeeze) into a sealing element. For example, compression load cells may be used, which are bent or compressed as opposed to a tension load cell which is pulled apart. Canister, beam, shear web, single point, and pancake are examples of compression-type load cells. As another example, a fiber optic sensor may be used, which may use optical fiber not only as a transmission medium, but also as a sensing element (referred as an intrinsic sensor).

In some implementations, while performing the downhole seal test, the downhole test apparatus 115 may use a timer and a pressure sensor to determine whether the pressure level holds for a period of time (e.g., such as a few minutes). For example, if 6 ksi of pressure was applied to either the test seal elements 222 or the packer elements 220 (or both), the downhole test apparatus 115 may determine whether the 6 ksi of pressure holds for a time period (e.g., such as 3 minutes or 5 minutes). For example, the pressure sensor of the downhole test apparatus 115 may monitor the pressure and the timer to determine whether the pressure holds for the time period. If the pressure level holds for the time period, the downhole test apparatus 115 may determine that the seal(s) of the packer elements 220 can withstand the necessary pressure level, and thus the packer elements 220 were set or actuated successfully. If the pressure level does not hold for the time period, the downhole test apparatus 115 may determine that the seal(s) of the packer elements 220 cannot withstand the necessary pressure level, and thus the packer elements 220 have not been set or actuated properly or have failed. In some implementations, a microcontroller or a microcomputer of the downhole tests apparatus 115 may determine whether the pressure level held for the time period (e.g., based on the sensor data). In some implementations, after completing the downhole seal test and determining the packer elements were set or actuated successfully (i.e., the downhole seal test was successful), the microcontroller or microcomputer may open a valve (such as a dump or relief valve) that may be located on the pressure lines 238 (or in the pressure ports 235 or in the downhole test apparatus 115) to release the pressure, as further described below.

In some implementations, after performing the downhole seal test, the downhole test apparatus 115 may provide an indication from downhole to the surface well equipment to indicate (or verify or report or transmit) the results of the downhole seal test, such as whether the packer elements 220 were set or actuated successfully. The downhole test apparatus 115 may provide one or more of various types of indications. For example, the indication may include at least one of a pressure change indication, a flow change indication, an electrical indication, an acoustic indication, a vibrational indication, a mechanical indication, a wireless indication (such as Wi-Fi), a light (such as fiber optic) indication, a temperature change indicator, a time change indicator, a position change indicator, among others, or any combination thereof. In some implementations, the downhole test apparatus 115 may provide a pressure change indication to the surface. For example, when the downhole test apparatus 115 opens a port or a valve (such as a dump or relief valve) in the pressure lines 238 to release the pressure after the downhole seal test is completed, the downhole test apparatus 115 may also open a port or a valve (such as a dump or relief valve) in the control line 230 to release the pressure. The pressure release may be detected at the surface as a pressure change, which may indicate the packer elements 220 were set or actuated successfully. In some implementations, an electrical wire or cable or line may be run inside the control line 230 or may otherwise be included within or be part of the control line 230. The control line 230 may be used to send an electrical indication or signal to the surface. In one example, the electrical wire may run all the way to the surface via the control line 230, the drill string, and other components. In another example, the electrical wire may run in the control line 230 (or may otherwise be included within or be part of the control line 230) from the downhole test apparatus 115 to another component or tool (such as a milling assembly) or to the drill string (e.g., see FIGS. 3-4). The control line 230 may provide the electrical signal to another device (such as a solenoid valve) that can provide a pressure change or other type of indication to the surface. For example, the electrical signal sent via the control line 230 may cause a solenoid valve or port to open, which may release pressure and provide a pressure change indication to the surface. The signal sent via the control line 230 may be an analog, a digital, a pulse width modulated or other type of signal. The signal may be a light signal, mechanical signal, fluid signal, etc. The signal may cause other actuations or manipulations to occur. For example, the signal may cause a port to close, causing a pressure increase. The signal may cause a port to open and close to provide repeating pressure pulses or pulses encoded with messages. The signal may cause a light or laser intensity to change. Therefore, in some implementations, the indication that is sent to the surface may change form as it is transmitted to the surface. For example, the indication may begin as an electrical indication or signal and then change (or be converted) to a pressure change indication that is detected at the surface. It is noted, however, that the indication may be provided to the surface by various other methods.

Figure 3:
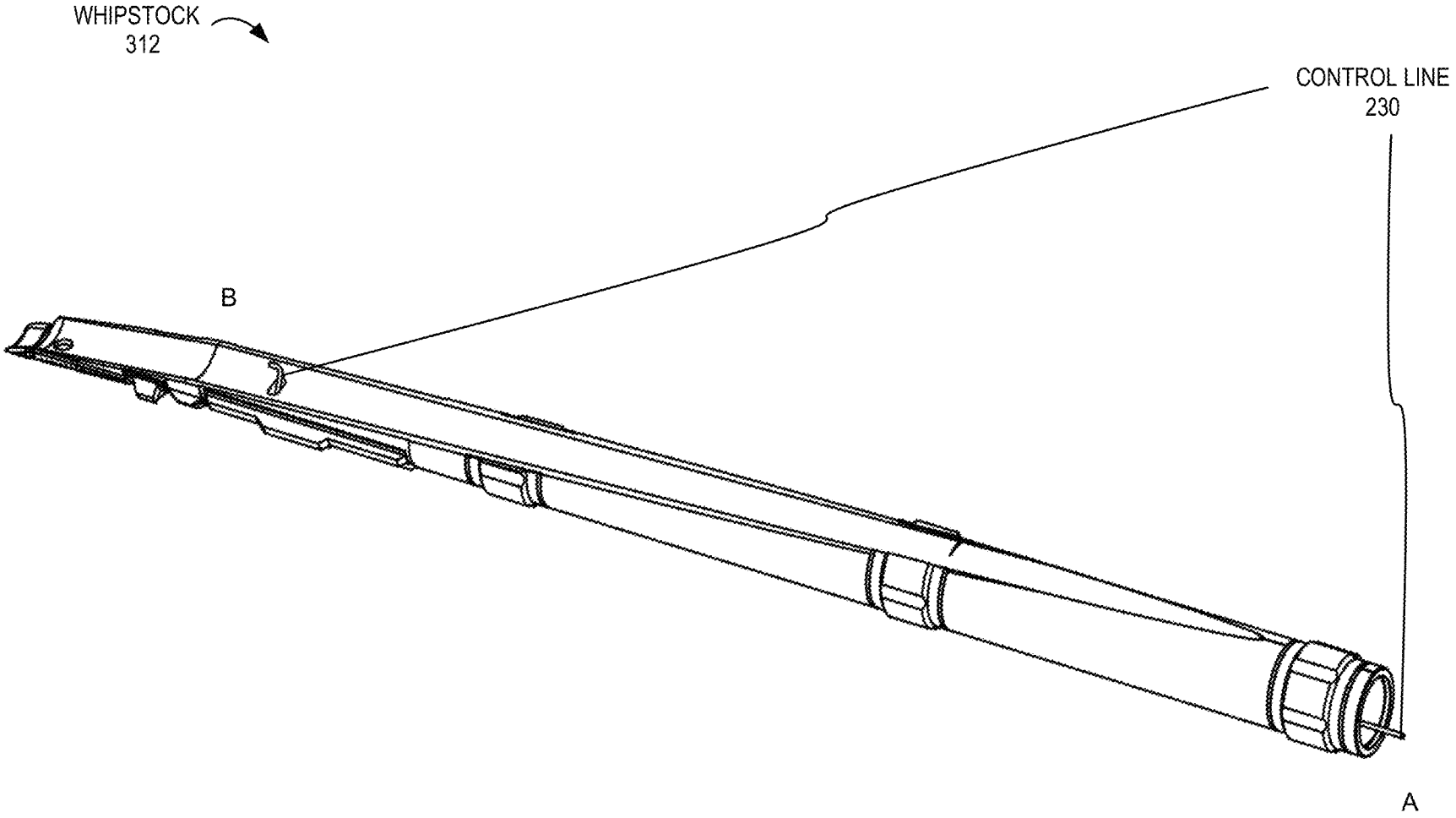
FIG. 3 depicts a schematic diagram of a whipstock having a control line for use in communicating with the surface well equipment, according to some implementations.

FIG. 3 depicts a schematic diagram of a whipstock 312 having a control line 230 for use in communicating with the surface well equipment. Although a whipstock 312 is shown as an example of a downhole well tool 112 (shown in FIGS. 1-2), it is noted that various other types of downhole well tools and devices may be similarly designed to include the control line 230. For example, the downhole well tools and devices may include a whipstock, a packer, an anchor, a whipstock and packer combination, or a whipstock and anchor combination, among others, and any combination thereof.

In some implementations, the portion of the control line 230 labeled as "A" may connect to the downhole test apparatus 115 shown in FIG. 2. As described previously, in this example, the downhole test apparatus 115 may be located in the whipstock 312, in a packer that is connected to (or built in with) the whipstock 312, or in an anchor that is connected to (or built in with) the whipstock 312. In some implementations, the portion of the control line 230 labeled as "B" may connect to another downhole well tool or device (such as a milling tool described below in FIG. 4) or to a drill string (such as the drill string 108 of FIG. 1) or to the surface equipment (such as the surface equipment 105 of FIG. 1). As described further herein, in some implementations, the control line 230 may be used to provide an indication to the surface equipment of the well system of whether a function performed by a downhole well tool or device was performed successfully. Control line 230 may be a conduit for containing one or more fluids. One or more fluids may be utilized to transfer pressure pulses, pressure changes, flow pulses, flow changes from the downhole test apparatus 115 to another downhole well tool or device or to a drill string. Control line 230 may also comprise other Energy Transfer Mechanisms (ETM) such as electrical wire(s), fiber optic cable(s), mechanical cable(s) to transfer energy in at least one direction, but in some implementations may be transferred in both directions. Control line 230 may comprise strain reliefs to prevent control line 230 from disconnecting under a load (strain) from operations not intended to break/severe/disconnect control line 230. Control line 230 may comprise stress-concentration features to encourage control line 230 to disconnect under a predetermined load (strain) from operations intended to break/severe/disconnect control line 230. For example, when releasing the milling assembly from the whipstock, the control 230 can be severed at a particular location (near location B) and not at location A or near control line coupling (fastening nut) at the milling assembly. The one or more ETMs located within the control line 230 may comprise one or more of the following: a strain relief to prevent the ETM from severing at a location that may compromise the performance of the ETM, control line 230, downhole test apparatus 115, etc.; a barrier and/or seal to prevent wellbore fluid, etc. from coming in contact with the downhole test apparatus 115 and its related components, a stress-concentration feature to encourage the ETM and associated features and components to severe at a predetermined location so as to protect the downhole test apparatus 115, its related components, the solenoid valve or other components related to the drill string in particular the components and devices for transmitting the indication 113 (and other signals or fluids, etc.) to and from other locales, such as surface 103.

Figure 4:
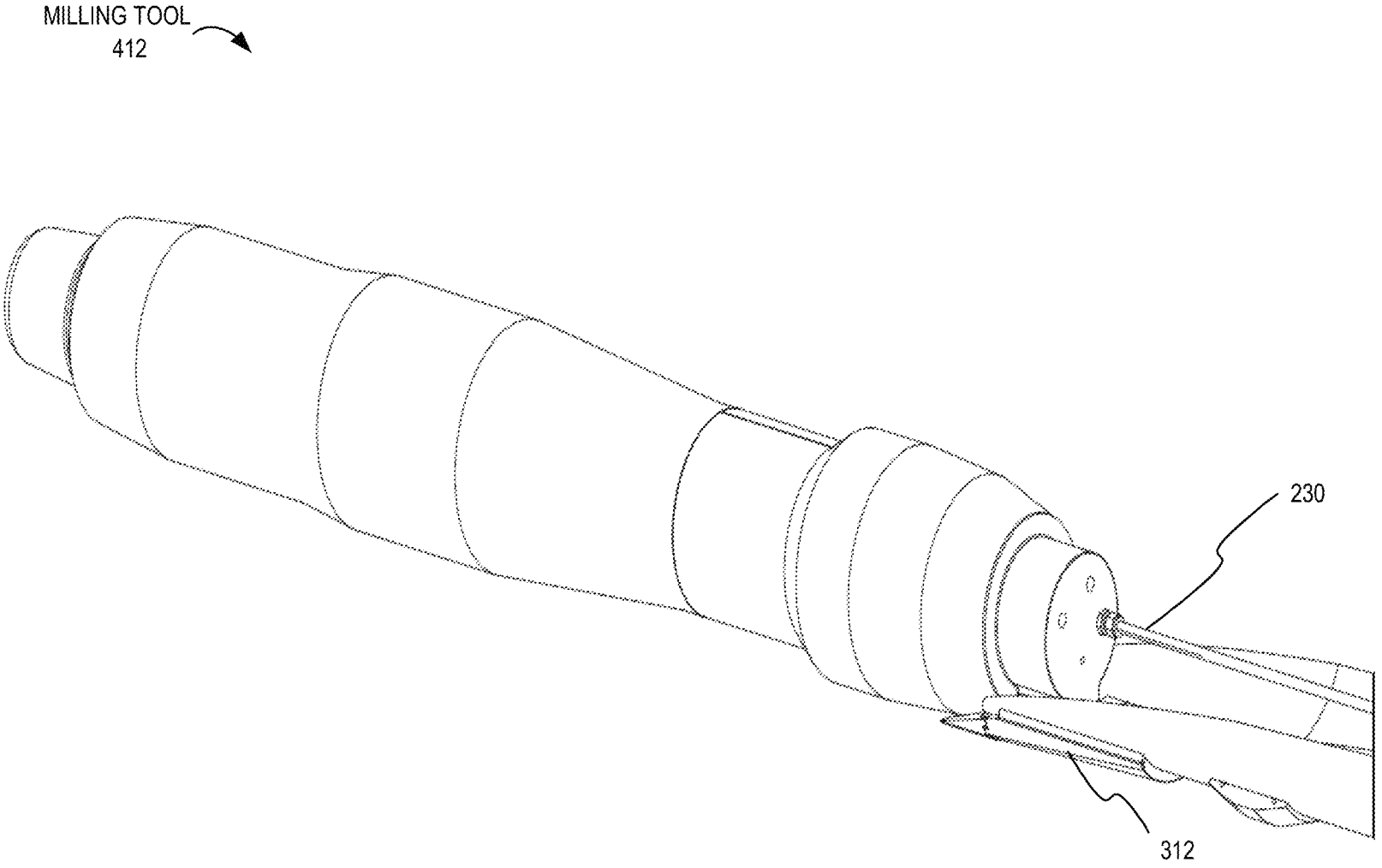
FIG. 4 depicts a schematic diagram of a milling tool and a whipstock having a control line for use in communicating with the surface well equipment, according to some implementations.

FIG. 4 depicts a schematic diagram of a milling tool 412 and a whipstock 312 having a control line 230 for use in communicating with the surface well equipment. As described in FIG. 3, although a milling tool 412 and a whipstock 312 are shown as an examples of downhole well tools (such as downhole well tool 112 shown in FIGS. 1-2), it is noted that various other types of downhole well tools and devices may be similarly designed to include the control line 230. For example, the downhole well tools and devices may include a work string and whipstock, a milling tool and a packer, a milling tool and an anchor, among others, and any combination thereof.

In some implementations, the control line 230 may form a connection between the whipstock 312 and the milling tool 412, which may be used to communicate with the surface equipment. For example, as described in FIG. 2, the control line 230 may be used to provide an indication to the surface equipment of whether a function performed by a downhole well tool or device (e.g., such as setting or actuating packer elements or engaging an anchor element) was completed successfully. The indication may include one or more of various types of indications, such as a pressure change indication, a flow change indication, an electrical indication, an acoustic indication, a vibrational indication, a mechanical indication, a wireless indication (such as Wi-Fi), a light (such as fiber optic) indication, a temperature change indicator, a time change indicator, a position change indicator, among others, or any combination thereof.

Figure 5:
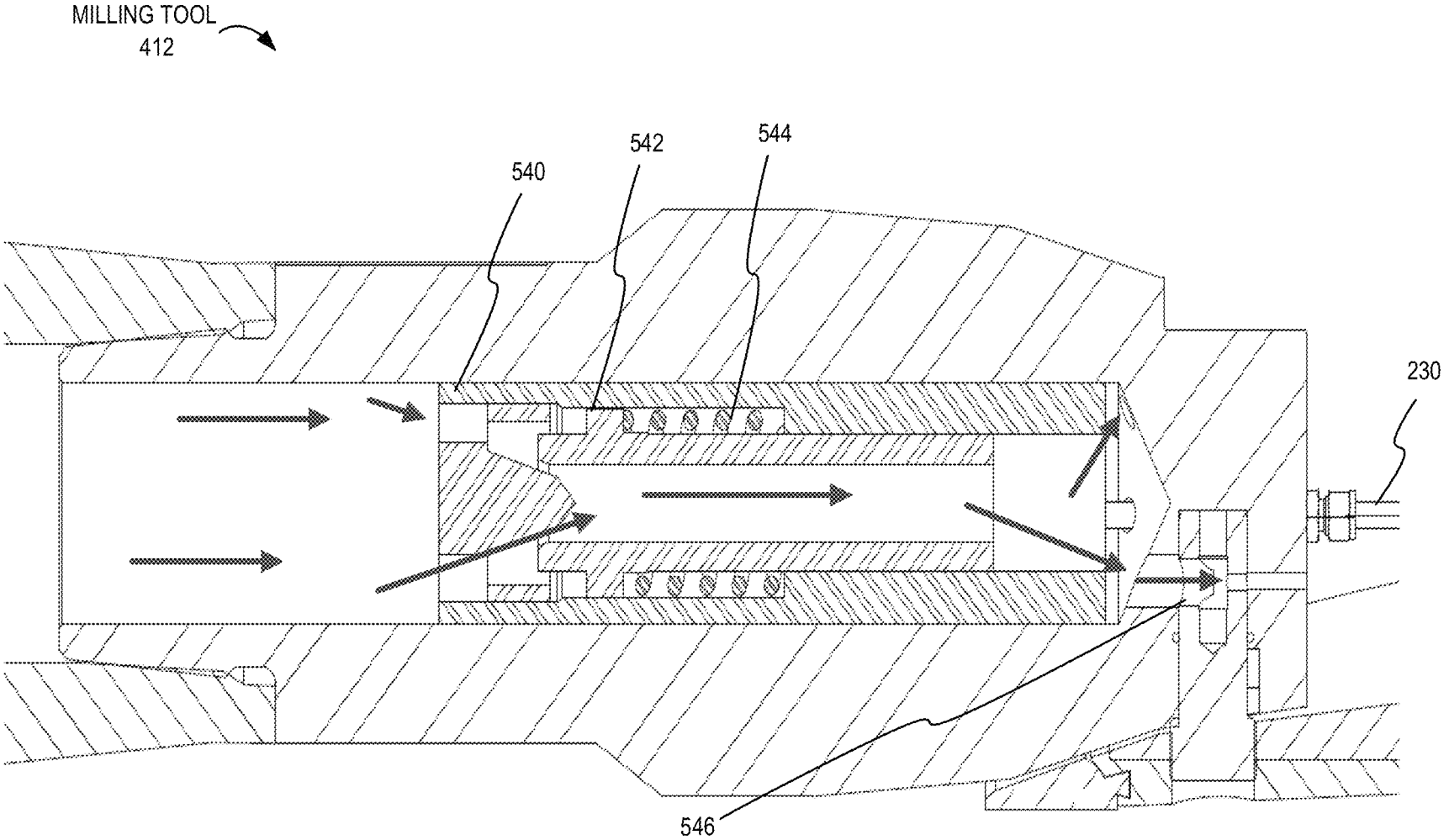
FIG. 5 depicts a schematic diagram of a milling tool including the control line and a shuttle valve for performing a function downhole, according to some implementations.

FIG. 5 depicts a schematic diagram of a milling tool 412 including the control line 230 and a shuttle valve 540 for performing a function downhole. In some implementations, the milling tool 412 may be a lead milling tool. As described in FIG. 3, although a milling tool 412 is shown in FIG. 5, it is noted that various other types of downhole well tools and devices may be similarly designed to include the control line 230 and the shuttle valve 540. For example, the downhole well tools and devices may include a drill or work string, a different milling tool (such as a follow milling tool or a dress milling tool), a whipstock, an anchor, among others, and any combination thereof. In some implementations, a different pressure and flow device may be used instead of a shuttle valve. For example, a solenoid may be used in the milling assembly or in the drill string to open valve or port, which may release pressure and provide a pressure change indication to the surface. In some implementations, the function that is performed by the shuttle valve 540 may include helping to set or actuate the packer elements. It is noted, however, that other functions may be performed, such as engaging an anchor element or anchor slips, among others.

In some implementations, after a pump of the surface well equipment begins pumping fluid downhole, the pressure from the fluid may push the piston 542 of the shuttle valve 540 and compress the springs 544. When the piston 542 is moved to compress the springs 544, this may be referred to as the open position of the shuttle valve 540, which may allow the fluid to flow through the flow holes 546 of the milling tool 412 (as shown by the arrows). As the flow continues through the flow holes 546, the pressure from the pumped fluid may continue to increase, and may be used to set or actuate packer elements, as will be described in FIG. 6.

Figure 6:
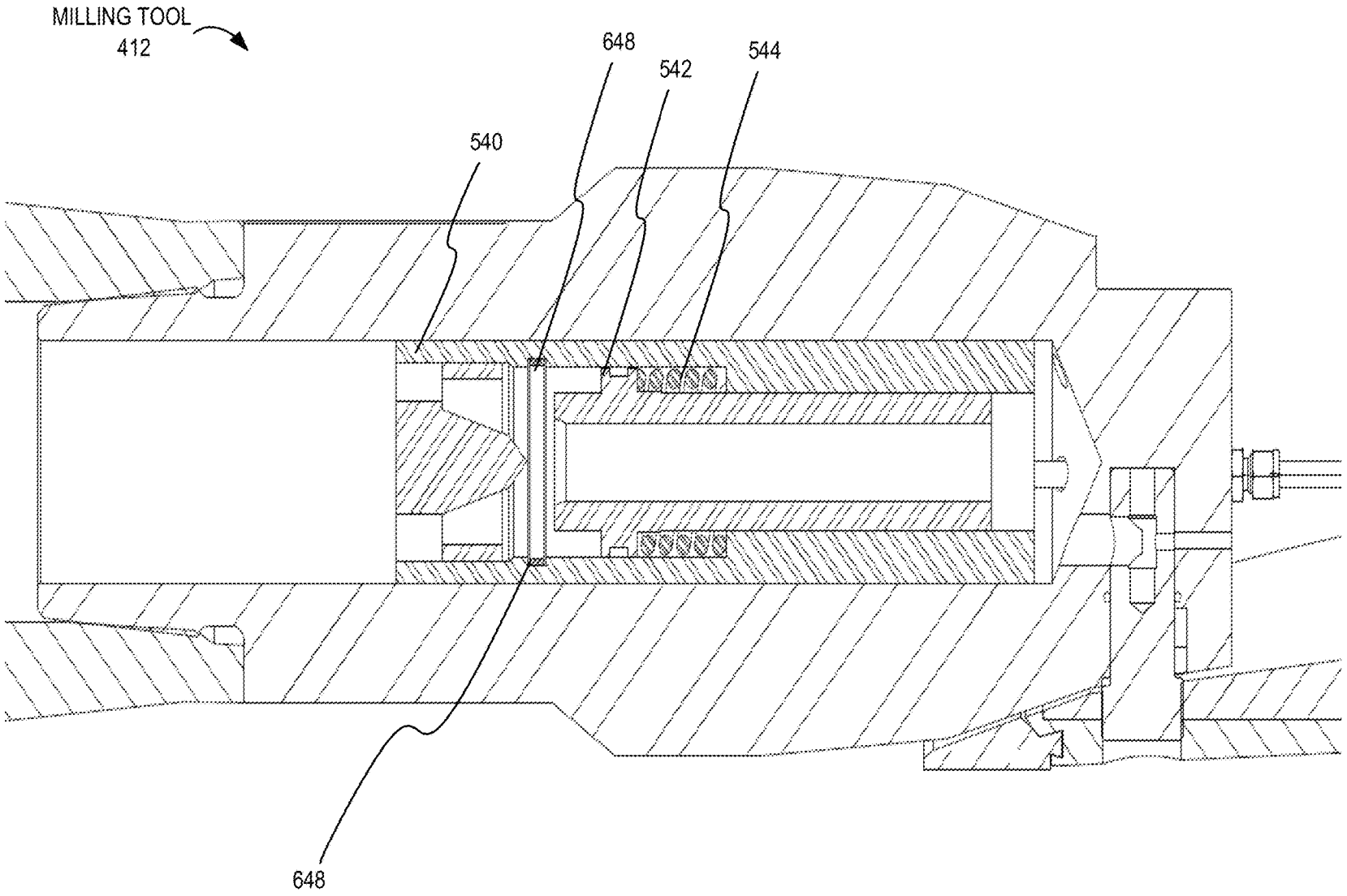
FIG. 6 depicts a schematic diagram of a milling tool including the control line and a shuttle valve for performing a function downhole, such as setting or actuating packer elements, according to some implementations.

FIG. 6 depicts a schematic diagram of a milling tool 412 including the control line 230 and a shuttle valve 540 for performing a function downhole, such as setting or actuating packer elements. As described in FIG. 5, the shuttle valve 540 may allow fluid that is being pumped from the surface to flow through the flow holes 546 of the milling tool 412 (as shown by the arrows). In some implementations, the flow of the fluid that is being pumped from the surface may be increased to continue to move the piston 542 and compress the springs 544, which may result in the activation of flow-activated locking dogs 648 or other locking mechanism. As the flow of the fluid increases the pressure from the pumped fluid may also increase. The increased pressure may be used to hydraulically set or actuate packer elements, such as the packer elements of a downhole well tool (such as the packer elements 220 of the downhole well tool 112 shown in FIG. 2).

Figure 7:
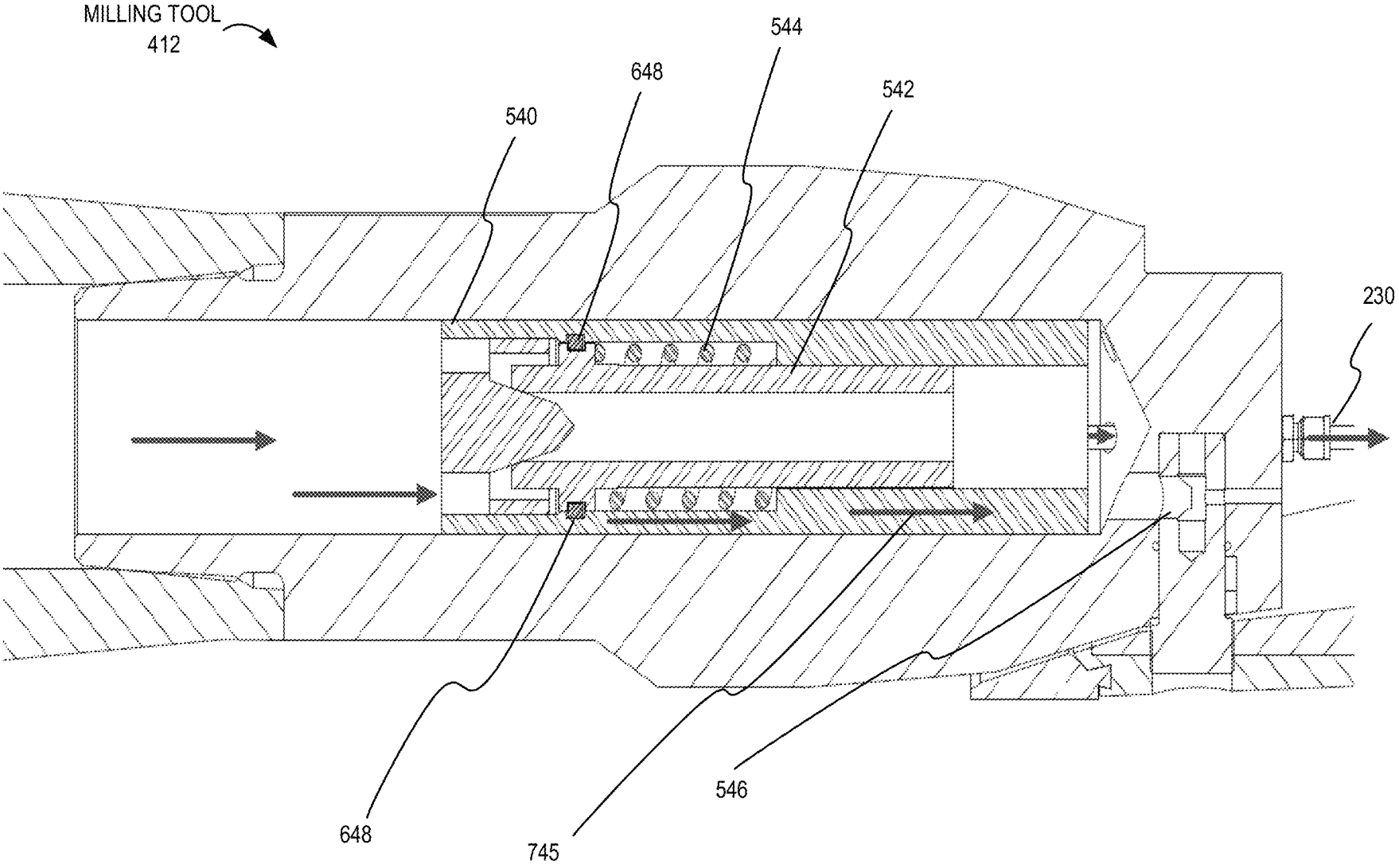
FIG. 7 depicts a schematic diagram of a milling tool including the control line and a shuttle valve for triggering a downhole test to determine whether a downhole function was performed successfully, according to some implementations.

FIG. 7 depicts a schematic diagram of a milling tool 412 including the control line 230 and a shuttle valve 540 for triggering a downhole test to determine whether a downhole function was performed successfully. In some implementations, after the packer elements are hydraulically set or actuated (as described in FIGS. 5-6), the flow of the pumped fluid from the surface may be decreased to allow the piston 542 of the shuttle valve 540 to be pushed backwards by the springs 544 (since the pressure from the fluid has decreased). When the piston 542 is pushed back, the flow-activated locking dogs 648 or other locking mechanism may lock the piston 542 in a closed position of the shuttle valve 540. The closed position of the shuttle valve 540 may close the flow holes 546. In some implementations, after the shuttle valve 540 is in a closed position (and the flow holes 546 are closed off), the flow of the pumped fluid from the surface may be slowly increased to divert the flow into ports 745 within the housing of the shuttle valve 540 (as shown by the arrows) that connect to the control line 230. The pressure or flow rate from the fluid that flows through the control line 230 may be used as parameter by a downhole device to initiate a downhole test. For example, the fluid that flows through the control line 230 or the pressure from the fluid flow may be used by the downhole test apparatus 115 (shown in FIG. 2) as a parameter or indicator to initiate a downhole seal test to determine whether the setting of the packing elements 220 was successfully completed. In some implementations, the downhole test apparatus 115 may use the fluid from the control line 230 to perform the downhole seal test. In some implementations, the downhole test apparatus 115 may use fluid within a reservoir of the downhole test apparatus 115 to perform the downhole seal test. The operations for performing the downhole seal test, determining whether the downhole seal test was successful or not, and providing an indication to the surface is described with reference to FIG. 2.

In some implementations, as described in FIG. 2, after the downhole seal test is completed and the results of the downhole seal test indicate that the packer elements were successfully set, the downhole test apparatus 115 may also open a valve (e.g., such as a dump or relief valve) in the control line 230 to release the pressure in the control line 230. The shuttle valve 540 may detect the pressure drop in the control line 230 and unlock the flow-activated locking dogs 648 or other locking mechanism to release the piston 542. For example, a pressure sensor may detect the pressure drop in the control line 230 and a microcontroller may unlock the flow-activated locking dogs 648 or other locking mechanism. When the piston 542 is released, the flow holes 546 may be open, which increases the flow of the fluid being pumped from the surface, since the size of the flow holes 546 are larger and provide a larger flow area than the control line 230. Also, if the control line 230 is plugged or closed, opening up the flow holes 546 would naturally provide an increase in the fluid flow. When the flow of the fluid increases, the pressure seen at the surface decreases. Thus, the pressure release may be detected at the surface as a pressure change (e.g., a pressure drop), which may indicate the packer elements were set or actuated successfully or not. In some implementations, after the surface receives the indication (such as a pressure change indication) that the packer elements were set or actuated successfully or not, the milling tool 412 may begin a milling operation for the well system. For example, the milling tool 412 (such as a lead milling tool) may be sheared from the whipstock (such as by shearing one or more shear screws) and the milling of a lateral wellbore of a multilateral wellbore may begin. It is noted that additional description regarding the shearing of the milling tool from the whipstock is described above with reference to FIG. 3.

Figure 8:
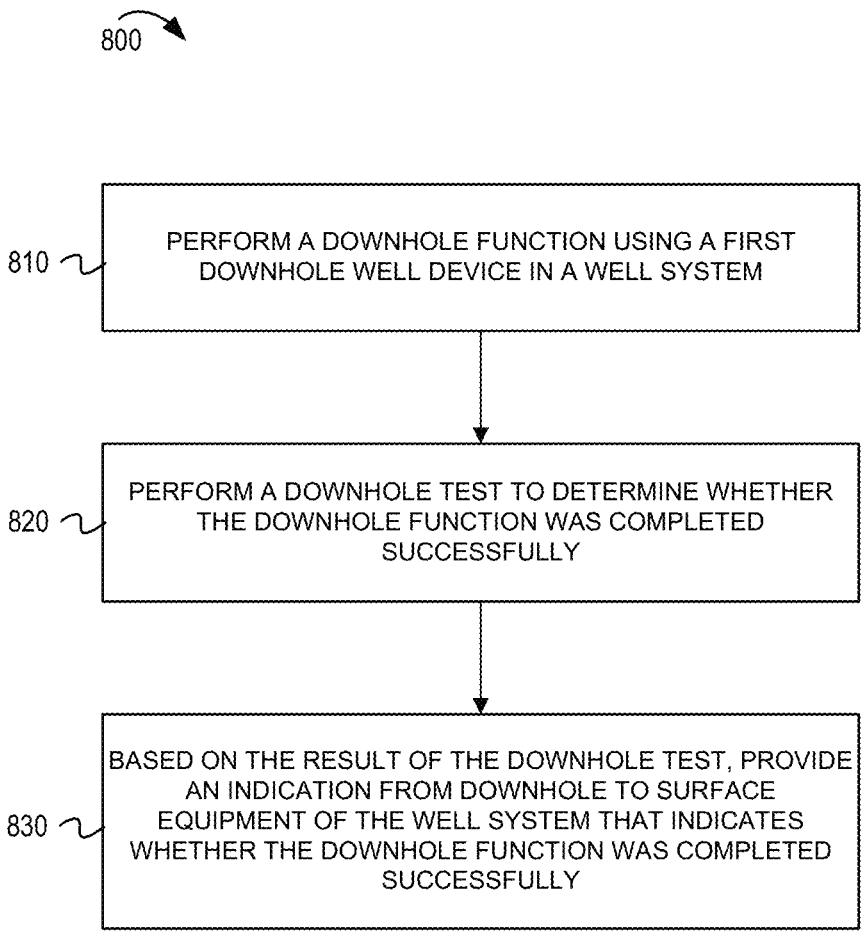
FIG. 8 is a flowchart of example operations for performing a downhole test in a well system and communicating the test results to the surface, according to some implementations.

FIG. 8 is a flowchart 800 of example operations for performing a downhole test in a well system and communicating the test results to the surface. The operations may include performing a downhole function using a first downhole well device in the well system (block 810). The operations may include performing a downhole test to determine whether the downhole function was completed successfully (block 820). The operations may include based on a result of the downhole test, providing an indication from downhole to surface equipment of the well system that indicates whether the downhole function was completed successfully (block 830). The indication may indicate that either the downhole function was completed successfully or the downhole function was not completed successfully.

Figure 9:
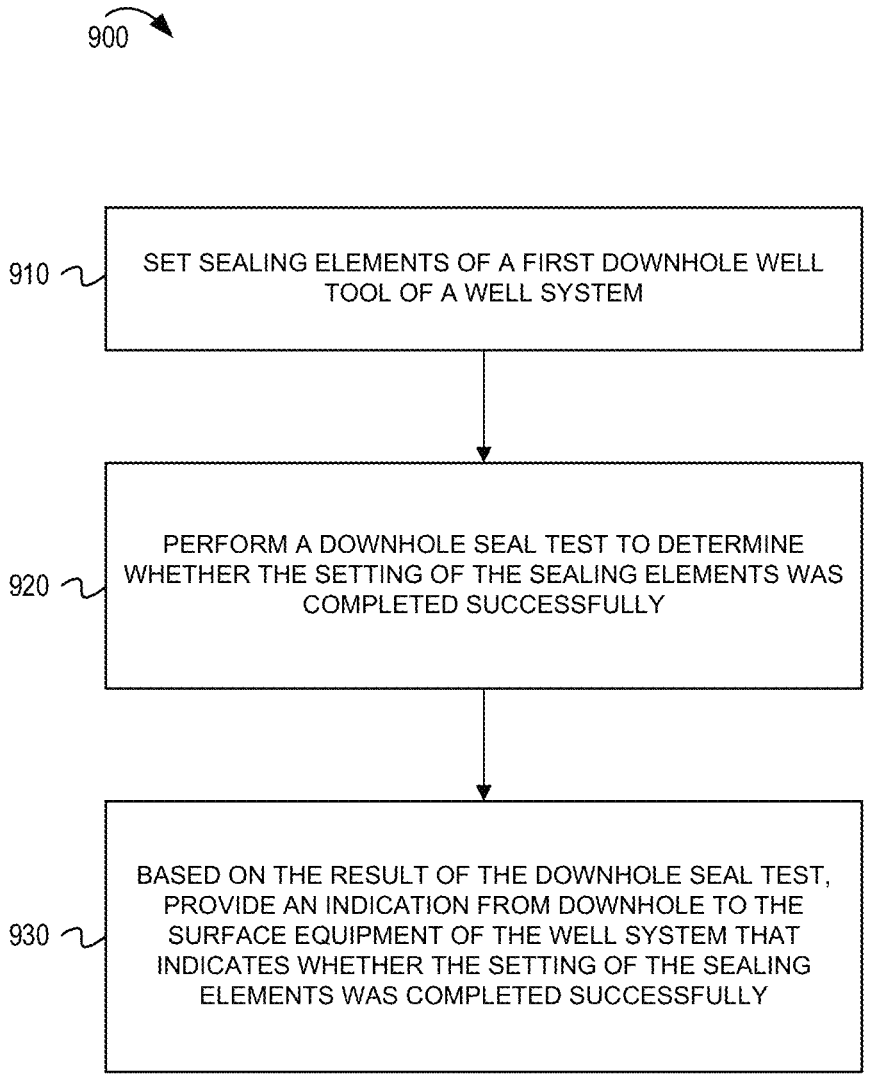
FIG. 9 is a flowchart of example operations for performing a downhole seal test in a well system and communicating the test results to the surface, according to some implementations.

FIG. 9 is a flowchart 900 of example operations for performing a downhole seal test in a well system and communicating the test results to the surface. The operations may include setting the sealing elements of the first downhole well tool of a well system (block 910). The operations may include performing a downhole seal test to determine whether the setting of the sealing elements was completed successfully (block 920). The operations may include, based on a result of the downhole seal test, providing an indication from downhole to surface equipment of the well system that indicates whether the setting of the sealing elements was completed successfully was completed successfully (block 930). The indication may indicate either that the setting of the sealing elements was completed successfully or that the setting of the sealing elements was not completed successfully.

In some implementations, the sealing elements are packer elements and the first downhole well tool is one of a packer, an anchor, a whipstock, a whipstock and packer combination, or a whipstock and anchor combination. In some implementations, the operation of performing the downhole seal test to determine whether the setting of the sealing elements was completed successfully may include at least one of testing one or more seals of the sealing elements of the first downhole well tool, and testing one or more seals of one or more test seal elements of the first downhole well tool. In some implementations, the one or more test seal elements may be located adjacent to the sealing elements of the first downhole well tool. In some implementations, the operation of performing the downhole seal test to determine whether the setting of the sealing elements was completed successfully may include providing, by a downhole test apparatus, a test pressure to one or more test seal elements of the first downhole well tool or to the sealing elements of the first downhole well tool, determining, by the downhole test apparatus, whether the test pressure holds for a time period, and determining, by the downhole test apparatus, that the setting of the sealing elements was completed successfully if the test pressure holds for the time period. In some implementations, the operation of providing the indication from downhole to the surface equipment of the well system that indicates whether the setting of the sealing elements was completed successfully may include, if the setting of the sealing elements was completed successfully, releasing the test pressure, releasing a pressure in a control line of the first downhole well tool, and providing a pressure change indication to the surface equipment based on the releasing of the test pressure and the releasing of the pressure in the control line. The pressure change indication may indicate the setting of the sealing elements was completed successfully.

Figure 10:
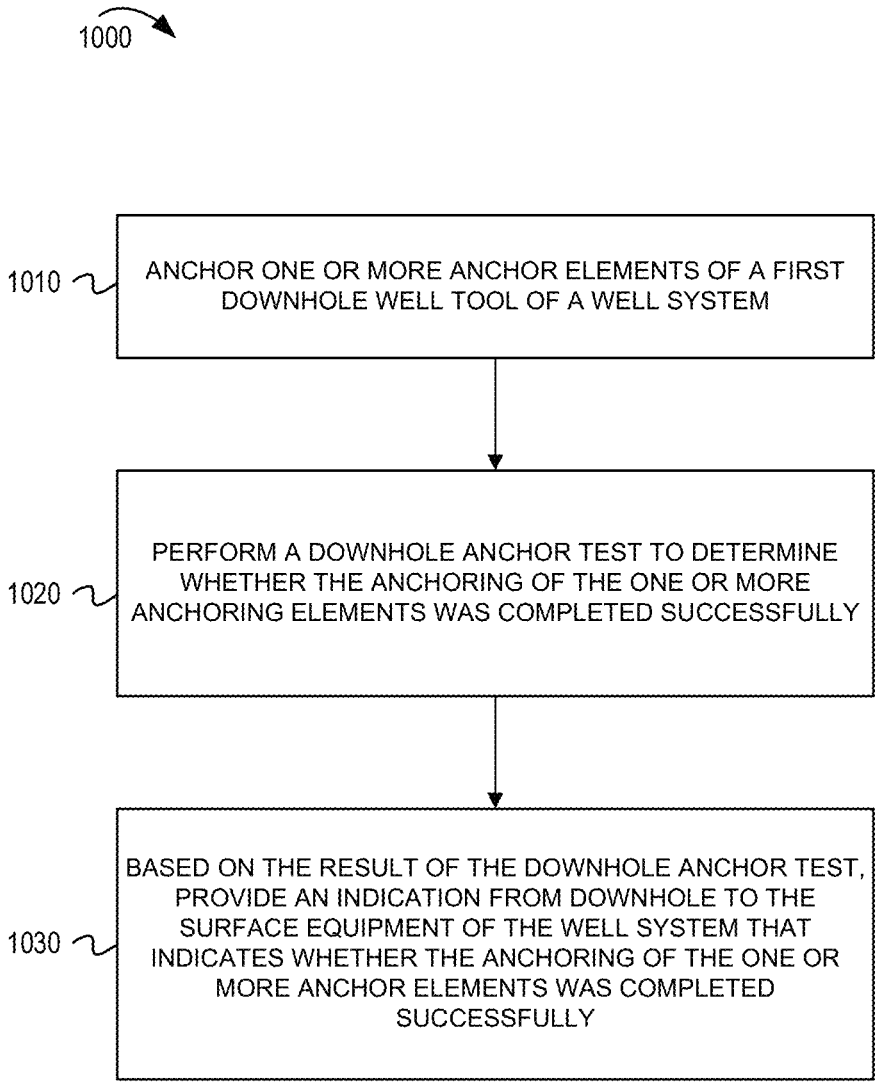
FIG. 10 is a flowchart of example operations for performing a downhole anchor test in a well system and communicating the test results to the surface, according to some implementations.

FIG. 10 is a flowchart 1000 of example operations for performing a downhole anchor test in a well system and communicating the test results to the surface. The operations may include anchoring the one or more anchor elements of the first downhole well tool of a well system (block 1010). The operations may include performing a downhole anchor test to determine whether the anchoring of the one or more anchor elements was performed successfully (block 1020). The operations may include, based on a result of the downhole anchor test, providing the indication from downhole to the surface equipment of the well system that indicates whether the anchoring of the one or more anchor elements was performed successfully (block 1030). The indication may indicate either that the anchoring of the one or more anchor elements was completed successfully or the anchoring of the one or more anchor elements was not completed successfully.

In some implementations, the anchor elements are anchor slips and the first downhole well tool is one of a packer, a retrievable sealbore packer, a permanent sealbore packer, seal assembly (including locator-type, anchor-type and other types), an anchor, a whipstock, a whipstock and packer combination, or a whipstock and anchor combination. The first downhole well tool may be deployed on a variety devices, such as a workstring or drill string, electric wireline, coiled tubing, or slickline. In some implementations, the operation of performing the downhole anchor test to determine whether the anchoring of the one or more anchor elements was performed successfully may include testing whether the one or more anchor elements are anchored to a casing of a wellbore, the wellbore, or other device of the well system.

Figure 11:
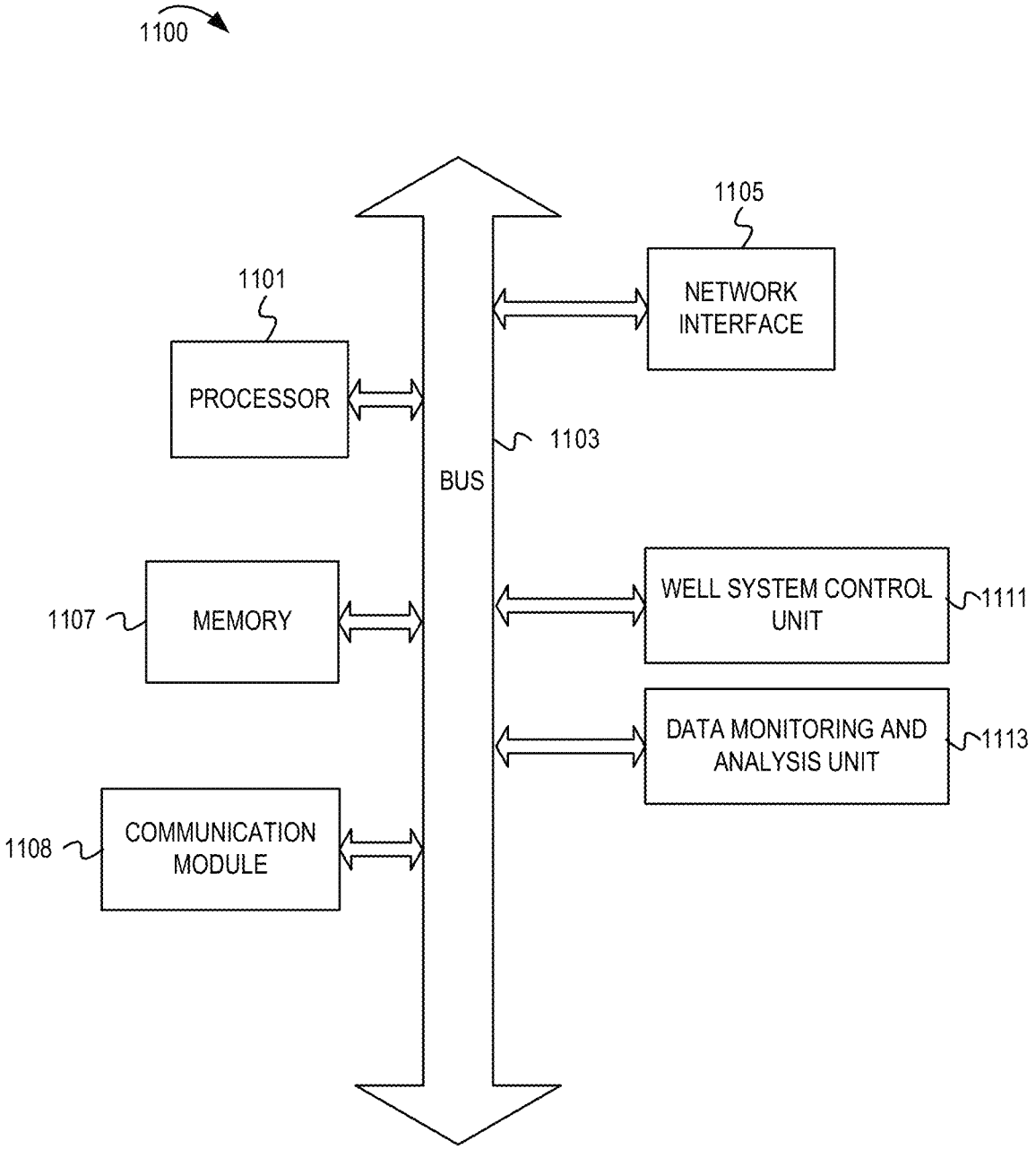
FIG. 11 depicts an example computer system that is used in a well system, according to some implementations.

FIG. 11 depicts an example computer system that is used in a well system. The computer system 1100 may be an example of a computer system that may be used during the operation of the well system, such as the computer system 110 shown in FIG. 1. Although a single computer system is shown, the computer system 1100 may be representative of one or more computer systems (e.g., laptops, desktops, workstations, computer systems integrated into surface well equipment, etc.) that may be used during the operation of the well system. The computer system 1100 may include one or more processors 1101 (possibly including multiple cores, multiple nodes, and/or implementing multi-threading, etc.). The computer system 1100 may include memory 1107. The memory 1107 may be system memory or any type or implementation of machine or computer readable media having instructions that are executable by the one or more processors 1101 to implement the operations described in FIGS. 1-10. The memory 1107 may also comprise system memory or any type or implementation of machine or computer readable and writable media having ability to receive, process and/or store data from sensors and devices (including those described in FIGS. 1-10). The computer system 1100 also may include a bus 1103 and a network interface 1105. The computer system 1100 also may include a communications module 1108 that may control wired and wireless communications, such as receiving sensor data from sensors installed in surface equipment and transmitting control information to control devices installed at surface equipment. The computer system 1100 also may include at least a well system control unit 1111 and a data monitoring and analysis unit 1113, among other processing units or modules that are used during the operation of the well system. For example, the well system control unit 1111 may control various well system surface equipment and downhole devices and tools, such as the surface pump, the drill string, the well sensors (surface and downhole), downhole well tools, and other well devices. The data monitoring and analysis unit 1113 may receive data from the surface equipment and other devices, such as sensor data, store the data, perform modeling and visualization of the data, and provide various other analytics information. The functionality described herein may be implemented with an application-specific integrated circuit, in logic implemented in the processor(s) 1101, in a co-processor on a peripheral device or card, etc. Further, implementations may include fewer or additional components not illustrated in FIG. 11 (e.g., video cards, audio cards, additional network interfaces, peripheral devices, etc.). The processor(s) 1101 and the network interface 1105 may be coupled to the bus 1103. Although illustrated as being coupled to the bus 1103, the memory 1107 may be coupled to the processor(s) 1101.

Figure 12:
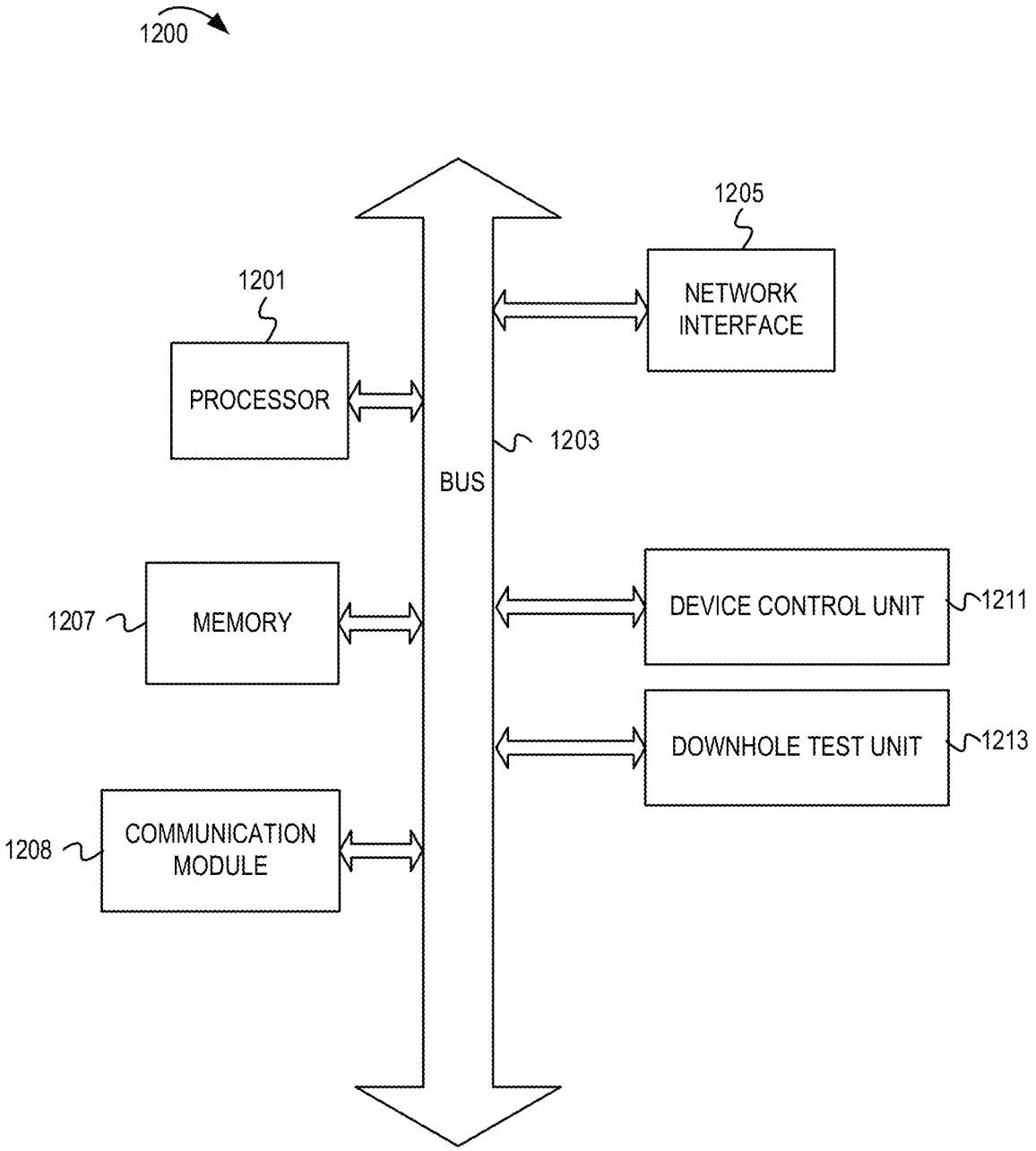
FIG. 12 depicts an example computer system that is used downhole in a well system for performing downhole tests.

FIG. 12 depicts an example computer system that is used downhole in a well system for performing downhole tests. The computer system 1200 may be an example of a downhole computer system that may be used downhole during the operation of the well system. For example, the computer system 1200 may be a microcomputer, microcontroller or types of computers and processing devices that may be used downhole in well systems. In some implementations, the computer system 1200 may be used downhole by one or more of the downhole test apparatus 115, the downhole well tool 112, the drill string 108, and other downhole well devices and tools. The computer system 1200 may include one or more processors 1201 (possibly including multiple cores, multiple nodes, and/or implementing multi-threading, etc.). The computer system 1200 may include memory 1207. The memory 1207 may be system memory or any type or implementation of machine or computer readable media having instructions that are executable by the one or more processors 1201 to implement the operations described in FIGS. 1-10. The memory 1207 may be system memory or any type or implementation of machine or computer readable and writable media having the ability to receive, process and/or store data from sensors and devices (including those described in FIGS. 1-11). The computer system 1200 also may include a bus 1203 and a network interface 1205. The computer system 1200 also may include a communications module 1208 that may control wired and wireless communications, such as receiving sensor data from downhole sensors, communicating with other downhole devices or tools, and communicating with surface equipment. The computer system 1200 also may include at least a device control unit 1211 and a downhole test unit 1213, among other processing units or modules that are used during the operation of the downhole well device or tool. For example, the well system control unit 1211 may control the operations of the downhole well device or tool (e.g., including related sensors and other components) during the operation of the well system. The downhole test unit 1213 may work in conjunction with one or more components (e.g., such as downhole sensors) to perform downhole tests (e.g., such as the downhole well tests described above in FIGS. 1-10). The functionality described herein may be implemented with an application-specific integrated circuit, in logic implemented in the processor(s) 1201, in a co-processor on a peripheral device or card, etc. Further, implementations may include fewer or additional components not illustrated in FIG. 12. The processor(s) 1201 and the network interface 1205 may be coupled to the bus 1203. Although illustrated as being coupled to the bus 1203, the memory 1207 may be coupled to the processor(s) 1201.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for performing downhole tests that determine or verify whether the functions were performed successfully by the downhole well tools and devices and communicating or reporting the downhole tests results to the surface via, at least in part, by the one or more (same or different) downhole well tools and devices as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

As used herein, the term "or" is inclusive unless otherwise explicitly noted. Thus, the phrase "at least one of A, B, or C" is satisfied by any element from the set {A, B, C} or any combination thereof, including multiples of any element.

EXAMPLE EMBODIMENTS

Example Embodiments can include the following:

Embodiment #1: A method for operating a well system, comprising: performing a downhole function using a first downhole well device in the well system; performing a downhole test to determine whether the downhole function was completed successfully; and based on a result of the downhole test, providing an indication from downhole to surface equipment of the well system that indicates whether the downhole function was completed successfully.

Embodiment #2: The method of Embodiment #1, wherein the first downhole well device is a first downhole well tool having sealing elements and the downhole function is a setting function for the sealing elements, further comprising: setting the sealing elements of the first downhole well tool; performing a downhole seal test to determine whether the setting of the scaling elements was completed successfully; and based on a result of the downhole seal test, providing an indication from downhole to the surface equipment of the well system that indicates whether the setting of the sealing elements was completed successfully.

Embodiment #3: The method of Embodiment #2, wherein performing the downhole seal test to determine whether the setting of the sealing elements was completed successfully includes at least one of: testing one or more seals of the sealing elements of the first downhole well tool; and testing one or more seals of one or more test seal elements of the first downhole well tool.

Embodiment #4: The method of Embodiment #2, wherein, based on the result of the downhole seal test, providing the indication from downhole to the surface equipment that indicates whether the setting of the sealing elements was completed successfully includes providing the indication of at least one indication type of a plurality of indication types, wherein the plurality of indication types include at least one of a pressure change indication, a flow change indication, an electrical signal indication, a magnetic indication, an inductive indication, a conductive indication, a temperature change indication, a position change indication, a time change indication, an acoustic indication, a vibrational indication, a mechanical indication, a wireless signal indication, a light signal indication, a stress indication, a strain indication, a force indication, a gamma ray indication, a radioactive indication, an energy level indication, a mass property indication, a fluid property indication, and a gas property indication.

Embodiment #5: The method of Embodiment #2, wherein performing the downhole seal test to determine whether the setting of the sealing elements was completed successfully includes: providing, by a downhole test apparatus, a test pressure to one or more test seal elements of the first downhole well tool or to the sealing elements of the first downhole well tool; determining, by the downhole test apparatus, whether the test pressure holds for a time period; and determining, by the downhole test apparatus, that the setting of the sealing elements was completed successfully if the test pressure holds for the time period.

Embodiment #6: The method of Embodiment #5, wherein providing the indication from downhole to the surface equipment of the well system that indicates whether the setting of the sealing elements was completed successfully includes at least one of: if the setting of the sealing elements was completed successfully, releasing the test pressure; releasing a pressure in a control line of the first downhole well tool; and providing a pressure change indication to the surface equipment based on the releasing of the test pressure and the releasing of the pressure in the control line, the pressure change indication indicating the setting of the sealing elements was completed successfully.

Embodiment #7: The method of Embodiment #2, wherein the sealing elements are packer elements and the first downhole well tool is one of a packer, an anchor, a whipstock, a whipstock and packer combination, or a whipstock and anchor combination.

Embodiment #8: The method of Embodiment #1, wherein the first downhole well device is a first downhole well tool having one or more anchor elements and the downhole function is an anchoring function for the one or more anchor elements, further comprising: anchoring the one or more anchor elements of the first downhole well tool; performing a downhole anchor test to determine whether the anchoring of the one or more anchor elements was performed successfully; and based on a result of the downhole anchor test, providing the indication from downhole to the surface equipment of the well system that indicates whether the anchoring of the one or more anchor elements was performed successfully.

Embodiment #9: The method of Embodiment #8, wherein performing the downhole anchor test to determine whether the anchoring of the one or more anchor elements was performed successfully includes: testing whether the one or more anchor elements are anchored to a casing of a wellbore of the well system.

Embodiment #10: The method of Embodiment #1, wherein the indication is initially a first indication type of a plurality of indication types, and the indication of the first indication type is translated to at least a second indication type of the plurality of indication types, and wherein the indication of the second indication type is provided from downhole to the surface equipment.

Embodiment #11: The method of Embodiment #10, wherein the plurality of indication types include at least two or more of a pressure change indication, a flow change indication, an electrical signal indication, a magnetic indication, an inductive indication, a conductive indication, a temperature change indication, a position change indication, a time change indication, an acoustic indication, a vibrational indication, a mechanical indication, a wireless signal indication, a light signal indication, a stress indication, a strain indication, a force indication, a gamma ray indication, a radioactive indication, an energy level indication, a mass property indication, a fluid property indication, and a gas property indication.

Embodiment #12: The method of Embodiment #10, wherein the indication of the first indication type is provided from the first downhole well device to a second downhole well device, and the indication of the first indication type is translated to the indication of the second indication type by the second downhole well device.

Embodiment #13: The method of Embodiment #12, wherein each of the first downhole well device and the second downhole well device is one of a plurality of downhole well device types, wherein the plurality of downhole well device types include at least two or more of a packer, an anchor, a whipstock, a drill string, a running tool, a retrieval tool, a fishing tool, a reservoir test tool, a perforating tool, a workover tool, a logging tool, a coring tool, a sample retrieval tool, and a plug.

Embodiment #14: The method of Embodiment #1, wherein, in response to providing the indication from downhole to surface equipment that indicates the downhole function was not completed successfully, further comprising: receiving an indication from the surface equipment indicating to perform the downhole function a second time; performing the downhole test to determine whether the downhole function was completed successfully the second time; and providing another indication from downhole to the surface equipment that indicates whether the downhole function was completed successfully the second time.

Embodiment #15: A downhole well device of a well system, comprising: a device mechanism configured to perform a downhole function in the well system; and a downhole test apparatus configured to: perform a downhole test to determine whether the downhole function was completed successfully; and based on a result of the downhole test, provide an indication from downhole to surface equipment of the well system that indicates whether the downhole function was completed successfully.

Embodiment #16: The downhole well device of Embodiment #15, further comprises sealing elements, wherein: the downhole function is a setting function for the sealing elements and the device mechanism is a device setting mechanism; the device setting mechanism is configured to set the sealing elements of the first downhole well tool; and the downhole test apparatus is configured to: perform a downhole seal test to determine whether a setting of the sealing elements was completed successfully, and based on a result of the downhole seal test, provide an indication from downhole to the surface equipment of the well system that indicates whether the setting of the sealing elements was completed successfully.

Embodiment #17: The downhole well device of Embodiment #16, wherein the downhole test apparatus configured to perform the downhole seal test to determine whether the setting of the sealing elements was completed successfully includes at least one of: the downhole test apparatus configured to test one or more seals of the sealing elements of the first downhole well tool; and the downhole test apparatus configured to test one or more seals of one or more test seal elements of the first downhole well tool.

Embodiment #18: The downhole well device of Embodiment #16, wherein the downhole test apparatus configured to perform the downhole seal test to determine whether the setting of the sealing elements was completed successfully includes the downhole test apparatus configured to: provide a test pressure to one or more test seal elements of the first downhole well tool or to the sealing elements of the first downhole well tool; determine whether the test pressure holds for a time period; and determine that the setting of the sealing elements was completed successfully if the test pressure holds for the time period.

Embodiment #19: The downhole well device of Embodiment #15, further comprising one or more anchor elements, wherein: the downhole function is an anchoring function for the one or more anchor elements and the device mechanism is a device anchoring mechanism; the device anchoring mechanism is configured to anchor the one or more anchor elements of the first downhole well tool; and the downhole test apparatus is configured to: perform a downhole anchor test to determine whether an anchoring of the one or more anchor elements was performed successfully, and based on a result of the downhole anchor test, provide the indication from downhole to the surface equipment of the well system that indicates whether the anchoring of the one or more anchor elements was performed successfully.

Embodiment #20: The downhole well device of Embodiment #15, wherein the indication is initially a first indication type of a plurality of indication types, and the indication of the first indication type is translated to at least a second indication type of the plurality of indication types, and wherein the indication of the second indication type is provided from downhole to the surface equipment.

Embodiment #21: The downhole well device of Embodiment #20, wherein the indication of the first indication type is provided from the first downhole well device to a second downhole well device, and the indication of the first indication type is translated to the indication of the second indication type by the second downhole well device.

Embodiment #22: The downhole well device of Embodiment #15, wherein, in response to providing the indication from downhole to surface equipment that indicates the downhole function was not completed successfully, the downhole test apparatus is configured to perform at least one of: receive an indication from the surface equipment indicating to perform the downhole function a second time; perform the downhole test to determine whether the downhole function was completed successfully the second time; and provide another indication from downhole to the surface equipment that indicates whether the downhole function was completed successfully the second time.

Embodiment #23: A drill string of a well system, comprising: a first downhole well device configured to perform a downhole function in the well system; and a downhole test apparatus configured to: perform a downhole test to determine whether the downhole function was completed successfully; and based on a result of the downhole test, provide an indication from downhole to surface equipment of the well system that indicates whether the downhole function was completed successfully.

Embodiment #24: The drill string of Embodiment #23, further comprising a second downhole well device, the second downhole well device configured to: receive the indication of a first indication type from the first downhole well tool; translate the indication of the first indication type to a second indication type; and provide the indication of the second indication type to the surface equipment.

What is claimed is:

1. A first downhole well tool of a well system, comprising:

one or more sealing elements;

a device setting mechanism configured to set the one or more sealing elements of the first downhole well tool; and a downhole test apparatus including a pressure line and a valve coupled with the pressure line, the downhole test apparatus configured to:

perform a downhole seal test to determine whether the one or more sealing elements were successfully set; and in response to determining from the downhole seal test that the one or more sealing elements were successfully set, actuate the valve to manage a pressure from the pressure line to provide a pressure change indication from the downhole test apparatus to surface equipment of the well system that indicates the one or more sealing elements were successfully set.

2. The first downhole well tool of claim 1, wherein the downhole test apparatus configured to perform the downhole seal test to determine whether the one or more sealing elements were successfully set includes at least one of:

the downhole test apparatus configured to test one or more seals of the one or more sealing elements of the first downhole well tool; or the downhole test apparatus configured to test one or more seals of one or more test seal elements of the first downhole well tool.

3. The first downhole well tool of claim 1, wherein the downhole test apparatus configured to perform the downhole seal test to determine whether the one or more sealing elements were successfully set includes the downhole test apparatus configured to:

provide a test pressure to one or more test seal elements of the first downhole well tool or to the one or more sealing elements of the first downhole well tool;

determine whether the test pressure holds above a pressure value for a time period; and determine that the one or more sealing elements were successfully set if the test pressure holds for the time period.

4. The first downhole well tool of claim 1, wherein the pressure change indication is initially a first indication type of a plurality of indication types, and the pressure change indication is translated to at least a second indication type of the plurality of indication types, and provided from downhole to the surface equipment.

5. The first downhole well tool of claim 4, wherein the pressure change indication is provided from the first downhole well tool to a second downhole well tool, and the pressure change indication is translated to another indication of the second indication type by the second downhole well tool.

6. The first downhole well tool of claim 1, wherein, in response to determining from the downhole seal test that the one or more sealing elements were not successfully set, the downhole test apparatus is configured to provide the pressure change indication from the downhole test apparatus to the surface equipment that indicates the one or more sealing elements were not successfully set, wherein, in response to providing the pressure change indication from the downhole test apparatus to the surface equipment that indicates the one or more sealing elements were not successfully set, the downhole test apparatus is configured to perform at least one of:

receive an indication from the surface equipment that causes the device setting mechanism to set the one or more sealing elements of the first downhole well tool a second time;

perform the downhole seal test to determine whether the one or more sealing elements were successfully set the second time; and provide another indication from the downhole test apparatus to the surface equipment that indicates whether the one or more sealing elements were successfully set the second time.

7. The first downhole well tool of claim 1, wherein the downhole test apparatus includes a portion of a control line, the control line coupled between the downhole test apparatus and the surface equipment, wherein the pressure change indication is provided from the downhole test apparatus to the surface equipment via the control line.

8. The first downhole well tool of claim 1, wherein the downhole test apparatus of the first downhole well tool is configured to provide the pressure change indication to a second downhole well tool that is configured to translate the pressure change indication into a flow change indication that is provided to the surface equipment, wherein the pressure change indication is provided to the second downhole well tool via a control line that is coupled between the downhole test apparatus and the second downhole well tool.

9. The first downhole well tool of claim 8, wherein the downhole test apparatus of the first downhole well tool is configured to provide the pressure change indication to a second valve of the second downhole well tool, wherein the pressure change indication is translated into the flow change indication by the second valve when the pressure change indication causes the second valve to adjust a fluid flow through the second valve.

10. The first downhole well tool of claim 1, wherein the pressure line is coupled with the one or more sealing elements, wherein the downhole test apparatus configured to perform the downhole seal test to determine whether the one or more sealing elements were successfully set includes:

the downhole test apparatus configured to apply a test pressure to the pressure line to pressure test the one or more sealing elements to determine whether the one or more sealing elements were successfully set.

11. The first downhole well tool of claim 10, wherein the downhole test apparatus further includes a pump coupled with the pressure line, wherein the pump of the downhole test apparatus is configured to apply the test pressure to the pressure line to pressure test the one or more sealing elements to determine whether the one or more sealing elements were successfully set.

12. The first downhole well tool of claim 11, wherein the downhole test apparatus further includes a pressure sensor and a computing device coupled with the pressure sensor, wherein the computing device of the downhole test apparatus is configured to determine whether the one or more sealing elements were successfully set based on sensor data received from the pressure sensor of the downhole test apparatus.

13. The first downhole well tool of claim 12, wherein the downhole test apparatus configured to actuate the valve to manage the pressure from the pressure line to provide the pressure change indication from the downhole test apparatus to the surface equipment of the well system that indicates the one or more sealing elements were successfully set includes:

the computing device of the downhole test apparatus configured to actuate the valve to manage the test pressure from the pressure line to provide the pressure change indication to the surface equipment to indicate the one or more sealing elements were successfully set.

14. A drill string of a well system, comprising:

a first downhole well tool including one or more sealing elements and a device setting mechanism, the device setting mechanism configured to set the one or more sealing elements of the first downhole well tool; and a downhole test apparatus including a pressure line coupled with the one or more sealing elements, the downhole test apparatus configured to:

perform a downhole seal test by applying a test pressure to the pressure line to pressure test the one or more sealing elements to determine whether the one or more sealing elements were successfully set; and in response to a determination from the downhole seal test that the one or more sealing elements were successfully set, provide an indication from the downhole test apparatus to surface equipment of the well system that indicates the one or more sealing elements were successfully set.

15. The drill string of claim 14, further comprising a second downhole well tool, the second downhole well tool configured to:

receive the indication of a first indication type from the first downhole well tool;

translate the indication of the first indication type to a second indication type; and provide the indication of the second indication type to the surface equipment.

16. The drill string of claim 14, wherein, in response to determining from the downhole seal test that the one or more sealing elements were not successfully set, the downhole test apparatus is configured to provide the indication from the downhole test apparatus to the surface equipment that indicates the one or more sealing elements were not successfully set.

17. The drill string of claim 14, wherein the downhole test apparatus includes a valve coupled with the pressure line, wherein the downhole test apparatus configured to provide the indication from the downhole test apparatus to the surface equipment of the well system that indicates the one or more sealing elements were successfully set includes:

the downhole test apparatus configured to actuate the valve to manage a pressure from the pressure line to provide a pressure change indication from the downhole test apparatus to the surface equipment to indicate the one or more sealing elements were successfully set.

18. The drill string of claim 14, wherein the downhole test apparatus further includes a pump coupled with the pressure line, wherein the pump of the downhole test apparatus is configured to apply the test pressure to the pressure line to pressure test the one or more sealing elements to determine whether the one or more sealing elements were successfully set.

19. A first downhole well tool of a well system, comprising:

one or more sealing elements;

a device setting mechanism configured to set the one or more sealing elements of the first downhole well tool; and a downhole test apparatus including a pressure line coupled with the one or more sealing elements, the downhole test apparatus configured to:

perform a downhole seal test by applying a test pressure to the pressure line to pressure test the one or more sealing elements to determine whether the one or more sealing elements were successfully set; and in response to determining from the downhole seal test that the one or more sealing elements were successfully set, provide an indication from the downhole test apparatus to surface equipment of the well system that indicates the one or more sealing elements were successfully set.

20. A drill string of a well system, comprising:

a first downhole well tool including one or more sealing elements and a device setting mechanism, the device setting mechanism configured to set the one or more sealing elements of the first downhole well tool; and a downhole test apparatus including a pressure line and a valve coupled with the pressure line, the downhole test apparatus configured to:

perform a downhole seal test to determine whether the one or more sealing elements were successfully set; and in response to a determination from the downhole seal test that the one or more sealing elements were successfully set, actuate the valve to manage a pressure from the pressure line to provide a pressure change indication from the downhole test apparatus to surface equipment of the well system that indicates the one or more sealing elements were successfully set.

* * * * *